US012018396B2

(12) United States Patent
Hou et al.

(10) Patent No.: US 12,018,396 B2
(45) Date of Patent: Jun. 25, 2024

(54) METHOD TO APPLY COLOR COATINGS ON ALLOYS

(71) Applicant: CIRRUS MATERIALS SCIENCE LIMITED, Auckland (NZ)

(72) Inventors: Fengyan Hou, Auckland (NZ); Christopher William Goode, Auckland (NZ); Ian John Mardon, Auckland (NZ)

(73) Assignee: Cirrus Materials Science Ltd, Auckland (NZ)

( * ) Notice: Subject to any disclaimer, the term of this patent is extended or adjusted under 35 U.S.C. 154(b) by 0 days.

(21) Appl. No.: 17/876,678

(22) Filed: Jul. 29, 2022

(65) Prior Publication Data

US 2022/0364253 A1 Nov. 17, 2022

Related U.S. Application Data

(63) Continuation of application No. PCT/NZ2021/050067, filed on Apr. 23, 2021.
(Continued)

(51) Int. Cl.
*C25D 5/44* (2006.01)
*C23F 13/00* (2006.01)
(Continued)

(52) U.S. Cl.
CPC ..... *C25D 3/12* (2013.01); *C23F 13/005* (2013.01); *C25D 5/44* (2013.01); *C25D 11/12* (2013.01)

(58) Field of Classification Search
None
See application file for complete search history.

(56) References Cited

U.S. PATENT DOCUMENTS 2,723,952 A 11/1955 Evangelides
2,313,754 A 3/1973 Loose
(Continued)

FOREIGN PATENT DOCUMENTS

CN 104562146 * 1/2015 ..... C25D 11/26
CN 105755518 7/2016
(Continued)

OTHER PUBLICATIONS

English translation JPH0633504. (Year: 1994).*
(Continued)

*Primary Examiner* — Stefanie S Wittenberg
(74) *Attorney, Agent, or Firm* — BrownWinick Law Firm; Christopher A. Proskey

(57) ABSTRACT

In example implementations, a method for coloring an alloy is provided. The method includes anodizing a substrate in an anodizing bath comprising phosphoric acid, at a constant temperature and a constant voltage for a first time period to develop an anodizing layer that includes a barrier layer, reducing the constant voltage applied to the anodizing bath for a second time period to change a thickness of the barrier layer and change a width of pores in the anodizing layer, plating the substrate in a plating bath at a first current that is increased over a third time period in accordance with a current profile of the plating bath, and plating the substrate in the plating bath at a second current for a fourth time period.

16 Claims, 13 Drawing Sheets

Related U.S. Application Data

(60) Provisional application No. 63/131,282, filed on Dec. 28, 2020, provisional application No. 63/015,421, filed on Apr. 24, 2020.

(51) Int. Cl.
*C25D 3/12* (2006.01)
*C25D 11/12* (2006.01)

(56) References Cited

U.S. PATENT DOCUMENTS

| | | | | |
|---|---|---|---|---|
| 3,962,049 | A * | 6/1976 | Ueki | C25D 11/22 205/174 |
| 4,251,330 | A | 2/1981 | Sheasby | |
| 4,968,389 | A | 11/1990 | Satoh et al. | |
| 5,064,512 | A | 11/1991 | Brodalla et al. | |
| 5,218,472 | A * | 6/1993 | Jozefowicz | B65D 81/3446 359/585 |
| 6,919,012 | B1 | 7/2005 | Bucar | |
| 9,562,302 | B2 | 2/2017 | Gao | |
| 2003/0008471 | A1 | 1/2003 | Norcott | |
| 2005/0178664 | A1 | 8/2005 | Ostrovsky | |
| 2007/0221508 | A1 | 9/2007 | Luo | |
| 2009/0223829 | A1 | 9/2009 | Gao | |
| 2013/0153427 | A1 | 6/2013 | Tatebe | |
| 2014/0117840 | A1 * | 5/2014 | Hatanaka | F21V 7/28 174/257 |
| 2015/0090597 | A1 * | 4/2015 | Tatebe | C25D 11/16 205/333 |
| 2016/0362808 | A1 * | 12/2016 | Yamamoto | C25D 11/08 |
| 2017/0221597 | A1 * | 8/2017 | Martin Gonzalez | C25D 11/026 |
| 2018/0051388 | A1 * | 2/2018 | Hou | C25D 11/30 |

FOREIGN PATENT DOCUMENTS

| | | |
|---|---|---|
| KR | 100680255 | 2/2007 |
| WO | 0118281 | 3/2001 |
| WO | 2005017235 | 2/2005 |
| WO | 2015015524 | 2/2015 |
| WO | 2018033862 | 2/2018 |
| WO | 2021215940 | 10/2021 |

OTHER PUBLICATIONS

Stepniowski et al. "Incoporation of copper chelate ions into anodic alumina walls", Materials Letters, 106, 2013, 242-245 (Year: 2013).*

Whelan et al. "Optimisation of Anodic Oxidation of Aluminum for Enhanced Adhesion and Corrosion Properties of Sol-Gel Coatings" ECS, 163, 5, C1-C8, 2016 (Year: 2016).*

Zankowski et al. "Combining High Porosity with High Surface Area in Flexible Interconnected Nanowire Meshes for Hydrogen Generation and Beyond", Applied Materials & Interfaces, 2018, 10, 44634-44644 (Year: 2018).*

International Search Report and Written Opinion—PCT/NZ2021/050067 dated Jul. 7, 2021.

International Search Report and Written Opinion—PCT/NZ2021/050067 dated Apr. 13, 2021.

Journal of Alloys and Compounds—A novel palladium-free surface activation process for electroless nickel deposition on micro-arc oxidation film of AZ91D Mg. alloy—Zhengwei Song, Zhihui Xie, Gang Yua, Bonian Hu, Xiaomei He, Xueyuan Zhang—Feb. 2015.

Journal of Alloys and Compounds—Tailoring the porous nanostructure of porous anodic alumina membrane with the impurity control—Alaa M. Abd-Elnaiem, A.M. Mebed, A. Gaber, M.A. Abel-Rahim—Feb. 2016.

Three-Dimensional Networked Nano-porous anodic Alumina Films with Vertical and Transverse Pores Fabricated on Al with Different Purity—Song-Zhu Chu et al. 2014 ECS Trans. 58 6.

The Formation Mechanism of 3D Porous Anodized Aluminum Oxide Templates from an Aluminum Film with Copper Impurities—Johannes Vanpaemel et al. J. Phys. Chem. C 2015, 119, 2105-21112.

The Formation Mechanism of 3D Porous Anodized Aluminum Oxide Templates from an Aluminum Film with Copper Impurities—Johannes Vanpaemel et al. J. Phys. Chem. C 2015, 119, 2105-2112.

* cited by examiner

501

502

503

1206

| Sample | 141019-1 | 141019-2 | 141019-3 | 141019-4 | 141019-5 |
|---|---|---|---|---|---|
| Anodizing Temperature (64 V) | 26-27 C | 27-29 C | 27.5-29 C | 33-27.5 | 28-30 C |
| Barrier Layer Thinning Voltage and time | 32 V x 6 mins, 16 V x 6 mins | 32 V x 4 mins, 16 V x 6 mins | 16 V x 10 mins | 32 V x 4 mins, 16 V x 6 mins | 32 V x 5 mins, 16 V x 6 mins |
| Barrier Layer Thinning Temperature | 26 – 27 C, 26 C | 27 – 27.5 C, 27.5 – 28 C | 25 – 28 C | 26 – 27.5 C, 25 – 26 C | 26.5 – 28 C, 25.5 – 26.5 C |
| Colour (L*, a*, b*) | 28.2, 0.6, -2.8 | 29.8, -0.3, -3.0 | 29.0, 1.6, -0.4 | 34.3, 0.65, -0.2 | 30.0, 0.1, -2.0 |

METHOD TO APPLY COLOR COATINGS ON ALLOYS

BACKGROUND

Various methods have been developed to coat colored anodized films on light metal alloys. In many cases, the exact coloration mechanism is not defined. However, it is generally understood that total internal reflection between the clear anodizing, the reflective substrate, and the inorganic deposits generates the change i luminance (L*), whereas the chrominance and hue (a*, b*) are created by destructive interference between the incoming and reflected light. In the case of organic coatings, coloration is often a direct consequence of the selected organic molecule.

In U.S. Pat. No. 4,251,330 ('330 patent), a mechanism to intensely color anodized aluminum or aluminum alloys is disclosed. In this patent, the substrate is direct current (DC) anodized to a thickness of 15 microns in a mostly sulfuric acid bath. The pores are widened in a mostly phosphoric bath using mostly alternating current (AC) anodizing. Coloration is provided by depositing mostly nickel from an acidic nickel sulfate, magnesium sulfate, and boric acid bath using AC. A variety of colors from purples, to blues, to greens is developed from destructive interference.

AC phosphoric anodizing was thought to be beneficial due to more uniform widening of the pores, while AC deposition resulted in a difference in deposition in the modified (widened) pores against the original narrow pores. The process disclosed in the '330 patent requires two baths to produce the pore structure necessary to color the surface, and thus, is less controlled.

Furthermore, the residual acid from the widening and deposition process leads to mudding of the colors, which requires a further neutralization step.

Patent EP018247981 discloses a direct coloration process using nickel sulfate in a sulfuric anodizing structure using AC deposition.

U.S. Pat. No. 5,064,512 discloses a process for dyeing a sulfuric anodized substrate using organic tin salts on sulfuric anodized substrates using AC or AC superimposed on DC coloration. This patent particularly discusses the need to stabilize the tin content of the bath and increase the throwing power of
the solution. The process requires a complex preparation of the tin containing coloration bath and close monitoring of the tin content to achieve the desired results.

Patent WO 01/18281 discloses a method for producing predominantly black anodized coatings by anodizing an aluminum or aluminum alloy substrate in a sulfuric bath to produce an oxide layer from 8-15 microns thick, modifying the pore structure in a predominantly phosphoric bath using reduced voltage AC or DC anodizing such that a large percentage of the pores become unable to participate in the coloration process, and coloring the anodized layer using a bath containing inorganic salts and a UNICOL® modified AC deposition regime. This process is largely a modification of the process disclosed in the '330 patent, discussed above, but relies on a different pore modification process. In each of the above cases, the coloration derives from modifying a sulfuric anodizing structure using a phosphoric process and then coloring the part using an inorganic bath.

SUMMARY

According to aspects illustrated herein, there is provided a method for coloring a light metal alloy. One disclosed feature of the embodiments is a method comprising anodizing a substrate in an anodizing bath comprising phosphoric acid, at a constant temperature and a constant voltage for a first time period to develop an anodizing layer that includes a barrier layer, reducing the constant voltage applied to the anodizing bath for a second time period to change a thickness of the barrier layer and change a width of pores in the anodizing layer, plating the substrate in a plating bath at a first current that is increased over a third time period in accordance with a current profile of the plating bath, and plating the substrate in the plating bath at a second current for a fourth time period.

One disclosed feature of the embodiments is a method comprising anodizing an aluminum alloy substrate in an anodizing bath comprising phosphoric acid, at a constant temperature and a constant voltage for a first time period to develop an anodizing layer that includes a barrier layer to be between 2 and 10 microns thick reducing the constant voltage applied to the anodizing bath for a second time period to change (i) a thickness of the barrier layer, located between the substrate and anodizing pores, and (ii) a width of pores in the anodizing layer, plating the aluminum alloy substrate in a plating bath at a first current that is increased over a third time period in accordance with a direct current (DC) plating current profile of the plating bath, plating the aluminum alloy substrate in the plating bath at a second current for a fourth time period to partially fill the pores in the anodizing layer with metal nanorods, and seal the pores of the anodizing layer to form a sealing layer. In one embodiment the step of sealing the pores leaves an airgap between the metal nanorods and the sealing layer.

One disclosed feature of the embodiments is a method comprising pre-treating an aluminum alloy substrate, activating the aluminum alloy substrate, anodizing the aluminum alloy substrate in an anodizing bath comprising phosphoric acid, at a constant temperature and a constant voltage for a first time period to develop an anodizing layer, reducing the constant voltage applied to the anodizing bath for a second time period to change a thickness of the barrier layer and change a width of pores in the anodizing layer, rinsing the aluminum alloy substrate to further reduce the thickness of the barrier layer, plating the aluminum alloy substrate in a plating bath via multiple plating stages to deposit a coloring metal nanorods into the pores of the anodizing layer, and sealing the pores of the anodizing layer while leaving an air gap above the metal nanorods.

DETAILED DESCRIPTION

Examples described herein provide a process to develop a thin colored coating on an aluminum or light metal alloy. As discussed above, various methods have been developed to coat alloys. Anodic oxide films on aluminum (including aluminum alloys) can be colored using both organic and inorganic coloring agents. The coloring occurs through deposition of organic or inorganic material in the pores using, generally, alternating current between the anodized surface and a counter electrode, while immersed in a bath containing the appropriate inorganic salt or combination of inorganic salts and organic molecules.

Previous methods have many drawbacks or may be inefficient. The present disclosure provides a method that can anodize and color aluminum, and other light metal surfaces, using a two-step process involving phosphoric anodizing and direct metal deposition. Thus, the process of the present disclosure may be more efficient and more environmentally friendly due to the use of less energy, fewer volatile organic compounds, and less waste.

In one embodiment, the process may incorporate one or more of the following steps: degreasing an alloy substrate, electropolishing the substrate, activating the surface, anodizing a film of between 2 and 10 microns on the substrate in an anodizing bath comprising substantially phosphoric acid at a desired temperature and following a desired voltage-current profile, electro-depositing a metal into the anodizing pores at a desired temperature and following a desired current profile, and sealing the pores with a transparent medium. The total average thickness of the hybrid coating may be around 2 to 15 microns.

Figure 1:
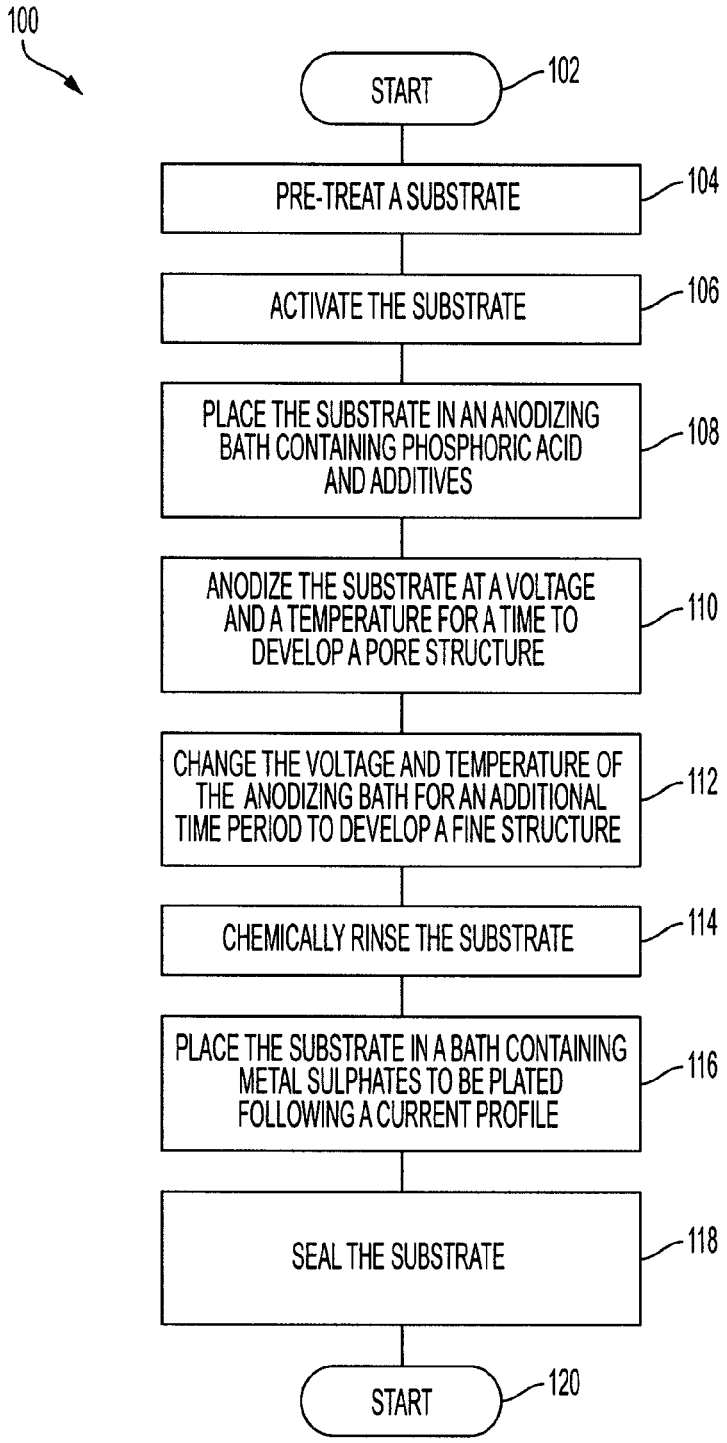
FIG. 1 illustrates a flow chart of an example method for producing a thin colored coating.

FIG. 1 illustrates an example method 100 for producing a thin film colored coating of the present disclosure. In one embodiment, the method 100 may be performed by various equipment or tools in a processing facility under the control of a processor or controller.

At block 102, the method 100 begins. At block 104, the method 100 may pre-treat a substrate. In one embodiment, the substrate may comprise aluminum or any alloy of aluminum.

The pre-treatment may include degreasing the substrate in an alkaline bath, roughening the substrate in a solution of polyethylene glycol, sulfuric acid and hydrofluoric acid, or other similar solution, and etching the substrate in a nitric acid solution. An example of such a pre-treatment may be a commercial aluminum surface pretreatment called Probright AL. The solution to roughen the substrate may clean the substrate surfaces as it etches.

One example of the pre-treatment may include the substrate first being treated by degreasing in a commercial solution such as Activax, commercially available from MacDermid, Inc. The degreasing step may be followed by rinsing. Rinsing of the substrate prior to anodizing may have the effect of eliminating impurities on the surface, which may cause imperfections in a thin anodized layer.

In one embodiment, the pretreatment may include electropolishing the substrate in a bath selected from the following ranges: 70-85% of $H_3PO_4$, 2-4 of HF, 6-9% of $H_2SO_4$, and 5-20% of glycerol. The electropolishing bath may be held at a temperature of between 70 and 80 Celsius (° C.) at a voltage (V) of approximately 12V. The electropolishing bath may include a Pb counter electrode. The electropolishing step creates a uniform surface of the substrate with a low average roughness ($R_a$), which contributes to achieving a glossy colored coating. The electro-polished substrate may then be rinsed in de-ionized (DI) water prior to the activating and anodizing steps, discussed below.

The average surface roughness, $R_a$, of the aluminum alloy substrate directly relates to the apparent gloss of the colored coating. In one embodiment, the $R_a$ of the substrate prior to anodizing may be between 1.8 and 4 to achieve a matte surface. In one embodiment, the $R_a$ may be approximately 2.

In one embodiment, the $R_a$ of the substrate prior to anodizing may be between 0.4 and 1.8 to achieve a semi-gloss surface. In one embodiment, the $R_a$ may be between approximately 0.8 and 1.2.

In one embodiment, the $R_a$ of the substrate prior to anodizing may be between 0 and 0.4 to achieve a gloss finish. In one embodiment, the $R_a$ may be less than approximately 0.2.

At block 106, the method 100 may activate the substrate. The substrate may be activated prior to anodizing. The activation step may provide some benefits on certain alloys. One example of the activation step may include activating the surface in a bath comprising 40% by volume $HNO_3$ and between 1 and 10 milliliters per liter (mL/L) of HF. In one embodiment, between 20% and 50% by volume of $HNO_3$ may also be used. The bath may be maintained at a temperature between 20° C.-25° C. with the substrate being immersed and agitated about once per second for between 20 and 40 seconds.

Figure 5:
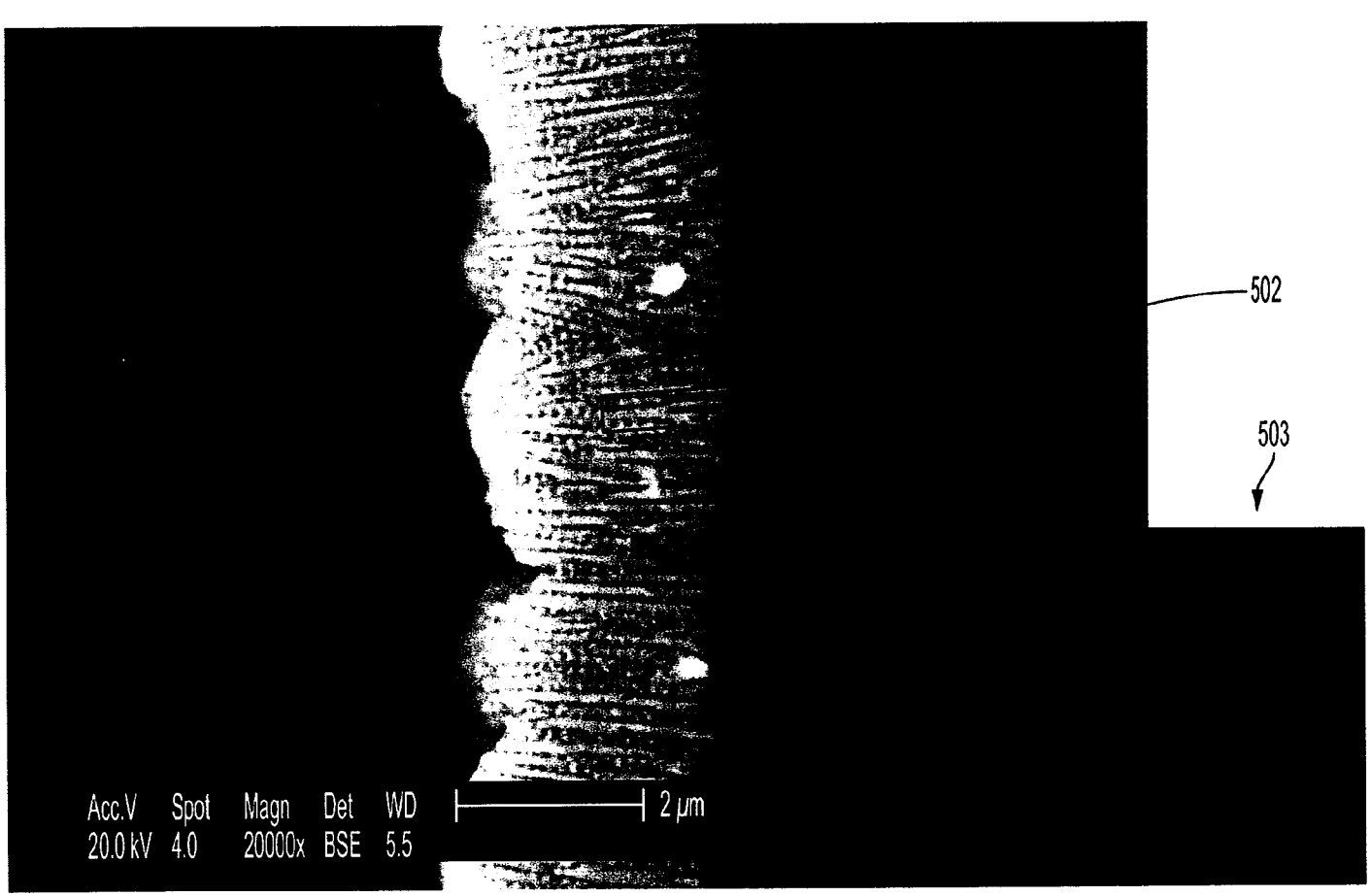
FIG. 5 is a SEM image of an example cross-section of an anodized colored substrate of the present disclosure.

At block 108, the method 100 places the substrate in an anodizing bath comprising phosphoric acid and additives or solvents that support the desired anodizing voltage and thus determine the pore structure which determines the resulting coating color. The bath may include at least phosphoric acid and sulfuric acid for an initial period to produce a thin anodized layer. In one embodiment, the temperature, electrical parameters, and bath composition contains a uniform high-density distribution of thin walled pores between 50 and 160 nanometers (nm) in diameter, as shown in FIG. 5, and discussed in further detail below.

The anodizing bath contains principally phosphoric acid with small amounts of sulfuric and oxalic acids. A bath composition is selected from the range of $H_3PO_4$ (40-600 ml per liter (ml/l)), $H_2SO_4$ (0-15 ml/l), and HOOCCOOH (1-10 grams per liter (g/L)). In one embodiment, the concentration of $H_3PO_4$ may be approximately 150 ml/l, the concentration of $H_2SO_4$ may be approximately 0.6 ml/l, and the concentration of HOOCCOOH may be approximately 1 g/l and the solvent is DI water.

In some embodiments, other additives may be added to attain a desired pore structure of the anodized layer. Examples of other additives may include small amounts of copper sulfate, a chelating agent, and the like, discussed in further detail below.

For any given phosphoric acid concentration in the anodizing bath, there may be a maximum anodizing thickness achievable due to the pore widening effect of the phosphoric acid. In one embodiment, the maximum anodizing thickness may be about 6 microns. While increasing the phosphoric acid concentration increases the conductivity of the anodizing bath, thus increasing the current density for a fixed anodizing voltage, increased phosphoric acid concentration may also increase the pore widening and film dissolution, giving rise to the aforementioned limit on thickness for the anodized film. The addition of a short chain alcohol in the range 0-15 weight percent (wt %), or approximately 10 wt %, has been shown to cool the growing pore structure and to reduce the surface dissolution of the porous anodized structure by the anodizing bath. The addition of ethylene glycol in the range of 0-80 wt %, or approximately 50 wt %, may increase the viscosity of the electrolyte, thereby reducing the rate of pore widening at the cost of lowering the growth rate of the porous anodized film. Low volumes of phosphoric acid may allow thicker anodizing layers. This may improve the coating mechanical performance, but requires longer anodizing times due to slower film growth.

The thickness of the barrier layer and pore structure has been shown to be factors in determining the coating color as described in the examples below. The thickness of the barrier layer is proportional to the anodizing voltage. However, the pore width is also proportional to the anodizing voltages. In many instances, the requirements of a thick barrier layer with narrower pores may play an important role in creating a functional colored coating. The addition of polyethylene glycol, or similar organics which increase the anodizing solution viscosity, in the range of 10-50 wt %, has been shown to allow higher anodizing voltages, which develop thicker barrier layers while keeping the pore size low or smaller than previous methods. The replacement of up to 50% of the $H_3PO_4$ with either $NaH_2PO_4$ or $LiH_2PO_4$ lowers the acidity and thus both the pore wall and barrier layer dissolution, allowing higher voltages, thicker barrier layers and narrower pore mouths. The thicker barrier layer so developed may be changed by thinning as described below to develop the correct or desired color for the coating.

At block 110, the method 100 anodizes the substrate at a voltage and a temperature for a time to develop a pore structure. For example, the substrate may be placed in an anodizing bath. The anodizing bath may be operated at a constant temperature between 5° C.-40° C., or between 27° C. and 31° C. The temperature of the bath may be regulated to develop the optimum pore structure. In one embodiment, the temperature may be maintained within ±2° C. In one embodiment, the temperature may be maintained within ±1° C. In one embodiment, the temperature may be maintained within ±0.5° C.

In one embodiment, a constant voltage may be applied to the anodizing bath. In one embodiment, the voltage may be between 60V and 280V and have a maximum current density of 2 amperes per square decimeter ($A/dm^2$) to provide an optimum pore distribution, density, and structure, as further described below.

In one embodiment, the initial voltage may be between 60 and 80 volts and the anodizing time period may be between 10 and 40 minutes. In one embodiment, voltage may be approximately 65V and the time period may be approximately 20 minutes.

The thickness of the anodized film/layer in the present disclosure may be developed or grown to be between 2 and 10 microns. However, the thickness may also be between 2 and 8 microns. In one embodiment, the thickness may be between 4 and 5 microns. Anodizing for 20 minutes at the above described conditions results in an anodized film of about 6 microns thick. In one embodiment, pulsed DC anodizing may be adopted. In one embodiment, the hue of the coating may be dependent on the thickness of the anodizing layer (also referred to herein as a barrier layer), as described below. For anodizing baths composed of an acid or a mixture of acids, the structure of the anodized layer may be generalized as comprising a compact barrier layer immediately adjacent to the alloy substrate, and a porous layer above the barrier wherein pores extend substantially perpendicularly from the barrier layer to the surface. At block 112, the method 100 may optionally change the voltage and temperature of the anodizing bath for an additional time period to develop a fine structure. For example, the thickness of the barrier layer and the width of the pores may be changed (e.g., reducing thickness of the barrier layer while increasing the width of the pores or increasing the thickness of the barrier layer while decreasing the width of the pores).

In one embodiment, the anodizing voltage may be reduced following a voltage profile to thin the barrier layer, and increase the light absorption and thus darken the color, as shown in FIG. 5. As described below, the width of the anodizing pores and the thickness of the barrier layer are produced as a function of the anodizing voltage and the dissolution power of the anodizing electrolyte(s). In one embodiment, the anodizing voltage is reduced by 50% and anodizing is continued for between 2 and 10 minutes, or for approximately 5 minutes in one embodiment.

In one embodiment, the anodizing voltage is similarly reduced by 50% for between 2 and 10 minutes, or for approximately 5 minutes in one embodiment. Then the anodizing voltage is reduced by 50% again for a further period of between 2 and 10 minutes, or for approximately 5 minutes in one embodiment.

In one embodiment, the anodizing voltage is ramped from the initial voltage to 15% of the initial voltage over a period of between 2 and 20 minutes, between 5 and 15 minutes, or between 8 and 12 minutes. It will be apparent to those skilled in the art that further reductions are possible with different voltages and time periods to create different pore structures.

At block 114, the method 100 optionally chemically rinses the substrate. For example, the substrate may be rinsed in a solution to further thin the barrier layer and prepare the substrate for plating the coloring metal. In one embodiment, the rinsing may thin the barrier layer by partially dissolving the anodizing endcaps. In one embodiment, the solution may be a bath comprising between 0.5-5 mL/L HF.

The anodized substrate to be processed may be immersed in the rinse bath for approximately 30 seconds, while being agitated about once per second. It will be apparent to those skilled in the art that other chemical baths and methods may be adopted to chemically thin the barrier layer.

At block 116, the method 100 places the substrate in a bath containing metal sulphates or cyanides to be plated following a current profile and develop metal nanorods at the base of the pores. In one embodiment, the nickel sulphate may, for example, be a source of metal for producing the colored coating, referred hereafter as a coloring metal. The coloring metal may be plated into the pores of the anodized layer of the substrate in an electro deposition bath following a plating current profile for a predetermined period. For example, a coloring electrodeposited coating may be applied to the anodizing film from a bath selected from a range of possible baths. The electrical parameters pertaining to the metallic coloring deposition are controlled by a first plating stage and a second plating stage. The first plating stage may include a first plating current that may be applied for a first plating period. The second plating stage may include a second plating current that may be applied for a second plating period.

In an alternative embodiment the coloring metal may be any pure metal including without limitation, silver, gold, copper, cobalt, tin or a metallic alloy including without limitation, zinc-nickel, nickel-phosphorous, cobalt-phosphorous or the like.

In one embodiment, the substrate may be optionally soaked in the metallic coloring solution for a period of between 0 and 6 minutes prior to the plating. In one embodiment, the substrate may be soaked for approximately 3 minutes. Soaking the substrate in the metallic coloring solution may allow the metal ions to fully diffuse into the pores and may allow any residual anodizing solution to be rinsed from the pores.

In one embodiment, the plating process to develop metal nanorods at the base of the pores and color the substrate may be performed in multiple stages. The first color deposition stage may proceed for the first plating period, during which the first DC plating current profile is set at a percentage of the second plating current, where the second plating current is set at a percentage of the nominal plating current for a chosen bath composition. The first plating current may be selected to be between 10% and 50% of the second plating current. In one embodiment, the first plating current may be selected to be approximately 33% of the second plating current.

The second plating current may be selected to be between 1% and 20% of the nominal plating current for a chosen bath composition. In one embodiment, the second plating current may be selected to be approximately 10% of the nominal plating current for a chosen bath composition. The first plating current profile may ensure the nucleation of the coloring metal at the bottom of the anodized porous structure. The nominal plating current may be defined by the Technical Data Sheet (TDS) provided by a formulator for a plating bath.

For example, the DC plating current for the semi-bright nickel bath referred to herein may be between 2 and 4 $A/dm^2$. In one embodiment, the nominal plating current may be 3 $A/dm^2$ for the bath described herein. The first current profile may be imposed such that the plating current is ramped from 0 to the selected current over 2 to 8 minutes. In one embodiment, the current may be ramped up over 3 minutes.

The second plating period may be sufficient to grow the metal nanorods to partially fill the anodizing pores, without reaching the top of any of the anodizing pores. In one embodiment, the second plating period is dependent on the thickness of the anodized film and the required luminance as further described below.

A sufficient time may be defined by the function below. In one embodiment, between 2 and 10 minutes may be sufficient time to produce a black surface in a semi-bright nickel bath with a second plating current of 10% of the nominal plating current in an anodizing layer of 6 microns. The plating rate for this reduced current has been shown to be between 0.05 and 0.5 times that for the bath under normal operating conditions. Thus, the plating period during which the plating current is applied may be approximated by Equation (1) below:

$$t = \frac{d * \text{fill fraction}}{n * \text{rate factor}}, \quad \text{Equation (1)}$$

where 't' is the plating period time in minutes, 'd' is the thickness of the anodized layer in microns, fill fraction is the desired average fill (i.e. the length of the metal nanorods as a percentage of the anodizing layer thickness) to produce a defined color, 'n' is the plating rate under normal bath operating conditions for the first electrodeposition bath in microns/minute, and rate factor is between 0.05 and 0.5 depending on the percentage reduction of the current, the normal plating efficiency of the selected plating bath, and the plating rate change versus current for this bath.

In one embodiment, pulsed DC or pulse/pulse reverse DC plating may be adopted. The pulse plating may result in uniform nanorod lengths by both limiting hydrogen evolution and changing the metal nucleation at the base of the anodizing pores.

In one embodiment, the first electro-deposited layer may be deposited from a semi-bright nickel bath such as Chemipure/Niflow, commercially available from CMP India. In another embodiment, the first electro-deposited layer may be deposited from a copper bath. In another embodiment, the electrodeposited layer may be deposited from a simple nickel sulfate bath. In another embodiment, the first electrodeposited layer may be deposited from a zinc-nickel bath, commercially available from Atotech Corporation. Here, the availability of zinc in the first electrodeposited layer may be beneficial to developing a transparent seal layer, as further described below. Other suitable metallic layers may be selected by those skilled in the art.

At block 118, the method 100 seals the substrate following one of several methods. For example, the coating (e.g., the color coating via plating of a metal described above) may be sealed. The coating may be sealed to ensure that the coating provides anti-corrosion performance while retaining the color. A coating of 6 microns has sufficient scratch resistance for most applications, but insufficient corrosion resistance without a sealing step.

In one embodiment, the sealing step may completely close the pores, making the surface of the substrate impervious to water and providing high corrosion resistance. Traditionally, anodizing has been sealed by immersing the plated, anodized, and colored substrate in a bath of boiling water or nickel acetate. Such a process provides only minimal corrosion protection of a coating comprising large pores created in a primarily phosphoric anodizing bath. To ensure that the sealing does not interfere with the coating appearance, the sealing layer may be both transparent and may provide a low refractive index space (airgap) above the metal nanorods. Apart from traditional sealing technology, two sealing approaches produce acceptable results.

Figure 13:
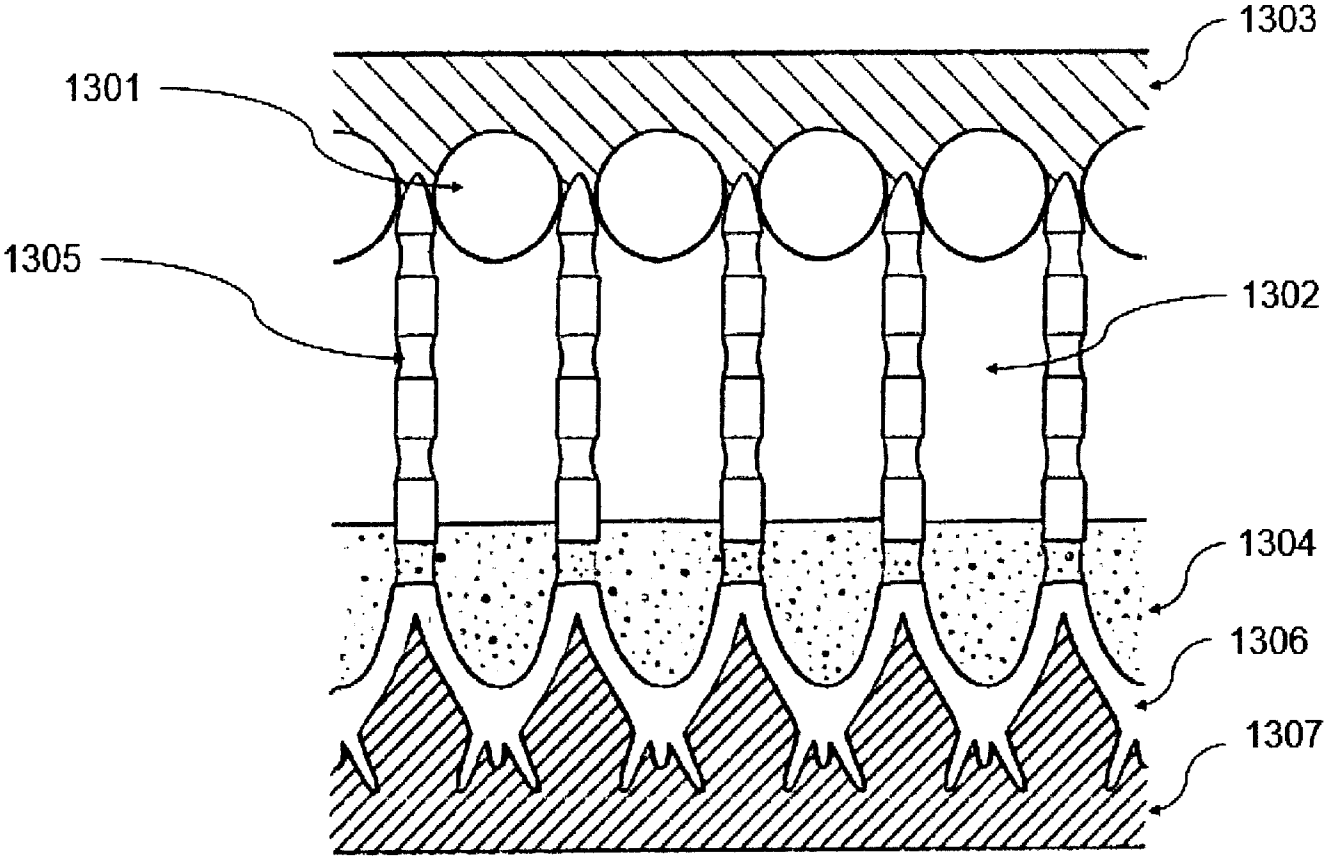
FIG. 13 is a cross section diagram of a coating according to one aspect of the invention showing the air gap to retain surface color

In one embodiment the required airgap is maintained by plugging the anodizing pores using transparent nano particles which are size matched to the width of the pore mouth. In one embodiment the transparent nanoparticles are polymethyl-methacrylate (pMMA) nano particles and an emulsion of pMMA in water or ethanol is applied to the colored surface. The inventors have found that applying a dilute solution to the surface successfully plugs the pores when the transparent nanoparticles are drawn into the pores by capillary action as the solvent (water, ethanol, or other suitable solvents) dries. In one embodiment that color is maintained by plugging between 60% and 100% of the pores. In a preferred embodiment >90% of the pores are plugged. FIG. 13 shows a cross section of a coating according to one embodiment of the invention where transparent pMMA nano particles 1301 block the anodizing tube pore mouths, 1302, allowing a transparent pDUDMA seal (or similar transparent seal), 1303, to cover and completely protect the coating surface while maintaining the airgap, in the pore 1302. This air gap is essential to maintaining the refractive index between the air and the pore walls, 1305 which is responsible for developing the color of the surface as described below.

In one embodiment appropriately sized transparent pMMA nanoparticles developed from a bath containing 20-100 mL/L of methyl-methacrylate (MMA) with 0.001-1 wt % to MMA of sodium dodecyl sulfate (SDS) to control the number and size of the micelles. The inventors have found that controlling the size of the micelles into which the MMA migrates controls the particle size. Sodium, or another alkaline metal, bicarbonate is added as a buffer at 0.5-2 wt % to MMA as a buffer to control the initiator kinetics and lower the polydispersity index of the pMMA to ensure transparency. Ammonium Persulphate (APS) is an initiator and is added at 0.4-2.5 wt % of monomer to polymerize the MMA. Sodium, or similar alkaline metal, bi-sulphite is added as reducing agent.

In an alternative embodiment any transparent nanoparticle may be used to plug the pore mouth.

In one embodiment the sealing approach uses a SOL/GEL process. In the SOL/GEL process the alumina SOL is produced and applied to the surface. In one embodiment, such an alumina SOL is prepared with aluminum tri-sec-butoxide (ATSB) at 0.025M with 1.5 mL of absolute ethanol per gram of ATSB, hydrochloric acid to adjust pH, and the rest of the solution made up with water of an appropriate purity. Those skilled in the art will appreciate the steps to combine these reagents in the correct order and by the correct method(s). The SOL can be applied by soaking the article in the SOL, spraying the surface with between 1 and 5 light coats, (3 light coats in some embodiments), or using electrophoretic deposition to fill the pores. In one embodiment, the SOL may fill the pores with little to no effect on the colored surface. After filing the pores, the substrate is baked at a temperature between 100° C. and 300° C. (approximately 120° C. in one embodiment) for a period of between 10 minutes and 480 minutes (approximately 30 minutes in one embodiment) to convert the SOL to a state whereby the SOL seals the surface and provides a transparent aspect.

In one embodiment, the sealing approach may use a surface polymerized coating. Here, the surface may be activated by heating to between 100 and 300° C. (approximately less than 200° C. in one embodiment) for a period of between 0 minutes and 180 minutes (approximately 30 minutes in one embodiment). Alternatively, the surface may be activated by dipping in a dilute solution of ZnO nanoparticles and drying before applying the monomer. A monomer is selected from precursors including, but not limited to, polyurethane dimethacrylate (PUDMA), methyl methacrylate (MMA), methyl acrylate (MA), butyl acrylate (BA), and butyl methacrylate (BMA). In one embodiment, PUDMA may be selected as the monomer. The monomer is applied to the surface by spin coating, spray coating, or other methods. The surface is illuminated with ultraviolet (UV) light at a wavelength of 200 nanometers (nm) to 400 nm (approximately 254 nm in one embodiment) at an intensity of 500 micro-Watts per square centimeter ($\mu W/cm^2$) and 2000 $\mu W/cm^2$ (approximately 1000 $\mu W/cm^2$ in one embodiment) for a period of between 2 and 60 minutes (approximately 10 minutes in one embodiment). The polymer is then cured at a temperature of between 30 and 120° C. (approximately 80° C. in one embodiment) for a period of 1 to 12 hours (approximately 2 hours in one embodiment). The result is a tough optically clear coating that is well bonded to the surface.

In another embodiment, the sealing layer may be an automotive clear coat or electrophoretic clear coat. It will be apparent to those skilled in the art that many sealing approaches may be adopted so long as the sealing material is optically transparent. At step 120, the method 100 ends.

Figure 2:
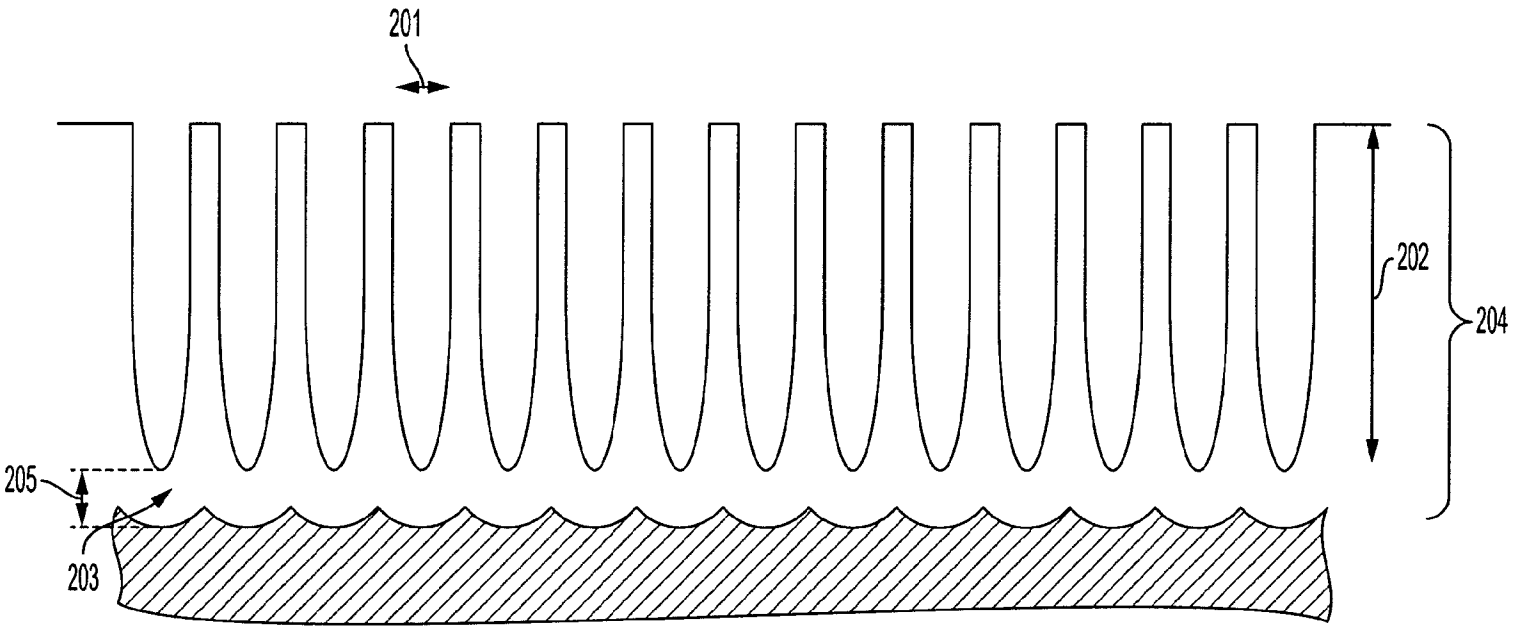
FIG. 2 illustrates an example sulfuric anodized substrate.

FIG. 2 illustrates an example anodized layer/coating 204. The anodized layer 204 may be produced from sulfuric bath and include a barrier layer 203. A pore width 201 may depend on the bath temperature, composition, and anodizing voltage. A pore depth 202 may depend on the anodizing voltage and time. A thickness shown by dimension 205 of the barrier layer 203 may depend on the bath composition and anodizing voltage. Directly coloring such a surface may be difficult due to the relatively narrow pores (e.g., 7-15 nm in diameter) and inter-pore distance.

Several methods have been developed to mitigate the direct coloration problems with different degrees of success. As briefly described above, one such method described in U.S. Pat. No. 4,251,330 and subsequent patents is commonly known as the Anolok II interference coloring process.

Here, a secondary phosphoric anodizing process at low voltages is used to expand the lower ends of the anodizing pores, effectively cutting off certain pores from the electrodeposition process. Metal is deposited in a subset of the pores, and color is produced by destructive interference between incoming light rays and reflected light rays. The light entering the empty pores is scattered by the metal filling the adjacent pores and darkens the surface.

Another example briefly described above is disclosed by WO 01/18281 ('181 patent). The '181 patent uses a combination of low voltage DC and AC pore expansion in a primarily phosphoric acid bath to create a branched nano pore structure after a sulfuric bath. This pore structure is filled using a modified AC electrodeposition from a bath containing metallic salts, typically nickel. The incoming light rays are scattered from the metal, and the coating has a dark or black aspect.

Figure 3:
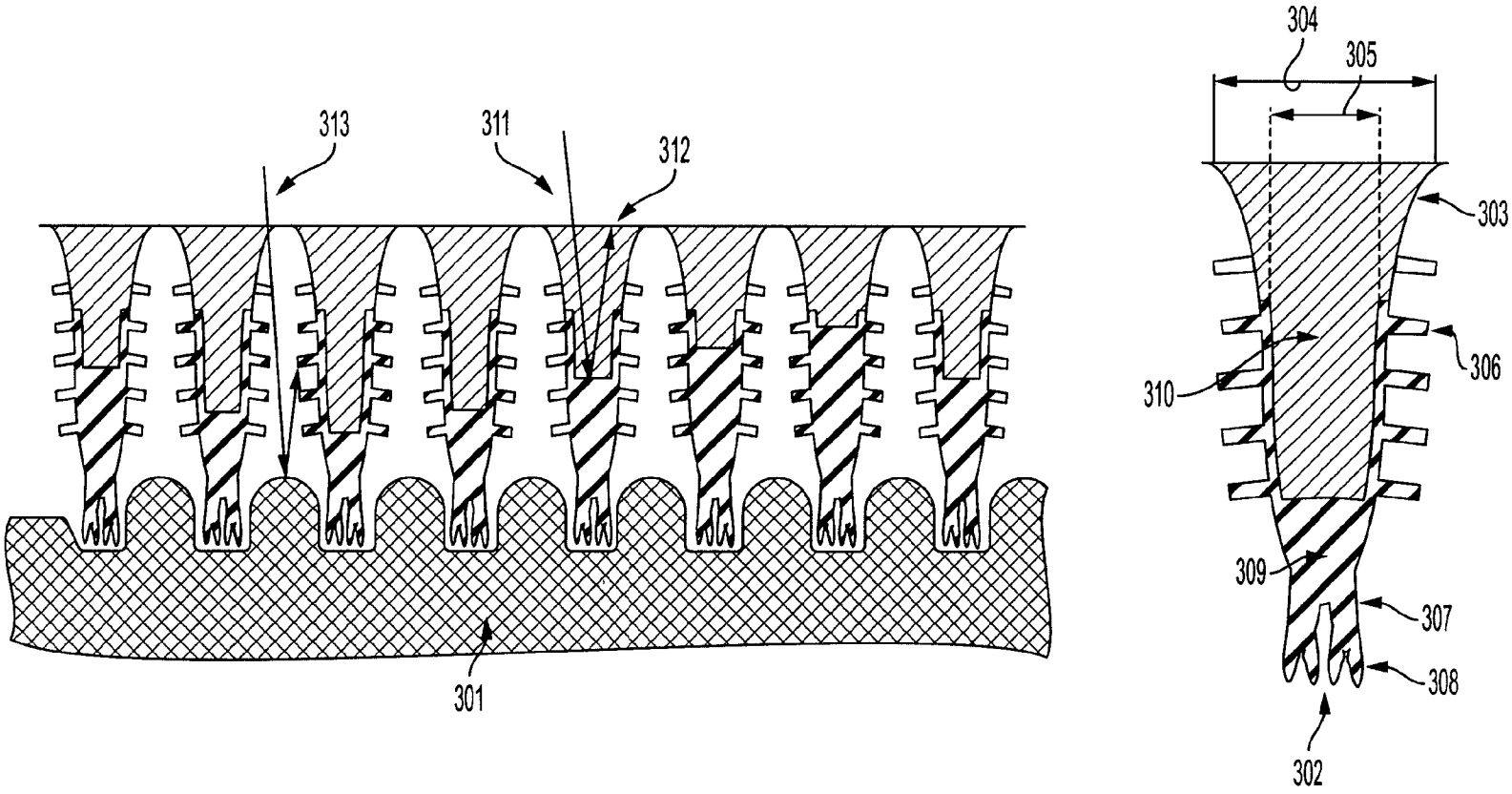
FIG. 3 illustrates an example phosphoric anodized substrate of the present disclosure.

FIG. 3 illustrates a cross-section of an example phosphoric anodized substrate 301 of the present disclosure. In one embodiment, the substrate 301 may be anodized in a principally phosphoric anodizing bath, as described above. Anodizing in a phosphoric bath, unlike the sulfuric bath, creates much wider pores. An enlarged diagram of a single anodizing pore 302 allows certain aspects of the invention to be more easily understood. A pore opening 303 may have a base diameter (dp.base) 305 from 50 to 150 nm, depending on the anodizing voltage (VA) and bath temperature. Phosphoric acid attacks the $Al_2O_3$ much more aggressively than sulfuric acid, which results in pore widening. A diameter at the surface (dp.surf) 304 is principally a function of the bath temperature and phosphoric acid concentration. In one embodiment, it has been found that the following relationships exist in accordance with Equations (2)-(5):

$$d_{p.base} \propto V_A \text{ in nm;} \quad \text{Equation (2)}$$

$$N_{pores} \propto \frac{0.25}{(d_{p.base})^2} \text{ in pores}/\mu m^2; \quad \text{Equation (3)}$$

-continued $$N_{pores} \propto \frac{1}{(V_A)^2} \text{ in pores}/\mu m^2; \quad \text{Equation (4)}$$

$$d_{p.surf} = 1.31^* d_{p.base} \quad \text{Equation (5)}$$

at the nominal bath operating temperature of between 18 degrees Celsius and 30 degrees Celsius and the phosphoric acid concentration.

The widening of the pores is a significant advantage of adopting a phosphoric anodizing bath, since the color is developed by interference between incident light 311 and reflected light 312. The widening of the pore 302 provides a wider viewing angle over which the color appears uniform. This is known as "flop" in commercial standards for application of pigmented and colored coatings.

It has been discovered that improved results are generated by thinning the barrier layer 203 illustrated in FIG. 2. The thickness of the barrier layer 203 is proportional to the pore width ($d_{p.base}$), which is proportional to the anodizing voltage (VA). Thus, to thin the barrier layer 203, a lower anodizing voltage can be used. The pore width is proportional to the anodizing voltage. Thus, halving the voltage will halve the width, e.g., four pores 307 may be developed at the base of a single pore 302, and the thickness of the barrier layer 203 may be halved. The sub pores (e.g., pores 307) may develop in a short time, typically less than 10 minutes, or less than 5 minutes in some embodiments. A second halving of the anodizing voltage generates a total of 16 sub-pores 308 and a very thin barrier of less than 25 nm. The thinning of the barrier layer 203 facilitates deposition of a coloring metal 309.

Figure 9:
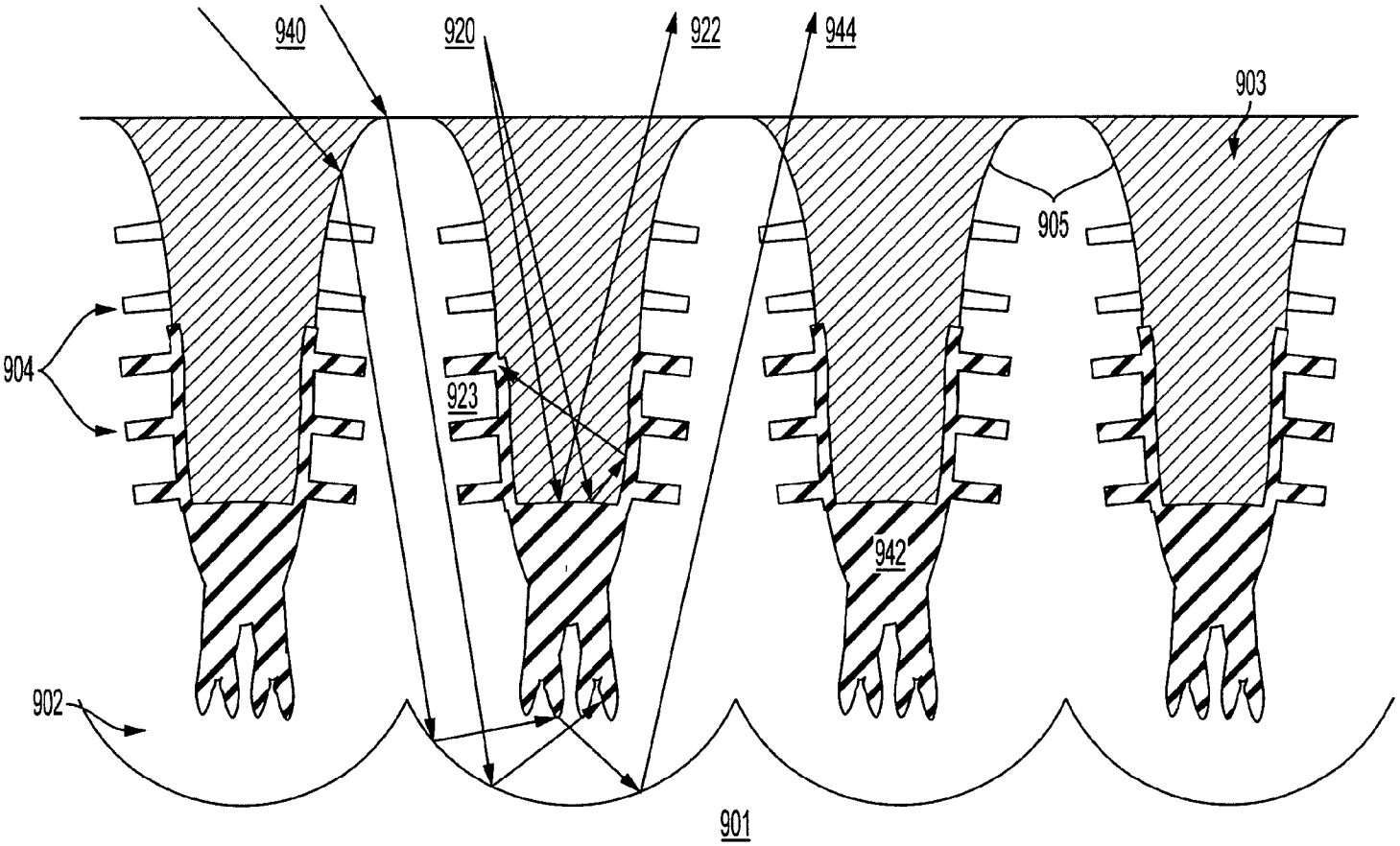
FIG. 9 illustrates an example diagram of the color generating mechanism of the present disclosure.

FIG. 9 illustrates an example diagram of the color generating mechanism of the present disclosure. FIG. 9 explains the principal processes by which both hue and luminance are affected by the anodized and plated coating according to present disclosure.

In one embodiment, the coating comprises a nano structured substrate 901, a barrier layer 902, a pore 903, and side pores 904 in pore walls 905. Two light paths are depicted. Light path 920 corresponds to light entering the pores 903. The light path 920 may be either directly absorbed by the nano structured metal coating or reflected by the nano structured metal coating. Reflected light can either exit a pore 903, as shown by a line 922, or be absorbed by the side pores 904, as shown by a line 923. The absorption is understood to be a combination of total internal reflection and surface plasmon effect. A light path 940 represents light either directly entering the pore walls 905 or entering the side pores 904 and being refracted by the pore walls 905. The metal coating on the pore walls 905 acts as a light guide, channeling the light to the substrate 901. The light is reflected/refracted by a boundary 942 of the film/substrate boundary and the film/nano structured metal boundary. A channel of the barrier layer 902 between the nano structured metal coating and substrate 901 acts as a band pass filter of the light, where the peak admission frequency is dependent on the thickness of the barrier layer 902. Light exiting the filter, as shown by a line 944, is conveyed to the surface through the pore walls 905. The relative refractive indices of the alumina film (905), the aluminum substrate (901) and the metal nanorods (942) and the air in the pore (903) are responsible for the color. The inventors have determined that the air gap is important to minimize light absorption (and thus black or dark coatings). A further contributor to color is the dimension of the photonic crystal formed by the side pore (904) spacing which is related to the barrier layer thickness.

Without being bound by theory, it may be understood that two distinct mechanisms may affect the perceived color of the coating. The luminance may depend on the pore size and light absorption in the pores. The hue may depend on the barrier layer thickness and uniformity.

Referring back to FIG. 3, some publications have suggested that horizontal pores 306, illustrated in FIG. 3, are due to copper in the aluminum alloy. However, when filled with nickel, the horizontal pores 306 can act as nano particles, absorbing light 313 through surface plasmon absorption.

Many aluminum alloys contain copper natively, for example 6061 aluminum contains between 0.15 and 0.4% copper, while 6022 aluminum contains 0.01-0.11% copper. The variation of the amount of copper creates variations in the number of horizontal pores 306 and consequently the darkness of the coating. Adding between 0% and 5% (or approximately 1% in one embodiment) of copper sulfate to the anodizing bath may allow the paucity of copper in some alloys to be overcome. A chelating agent, such as ethylenediaminetetraacetic acid (EDTA) or a similar chemical may prevent the deposition of copper onto the cathode plates.

Thus, the present disclosure clearly demonstrates the fundamental difference between colored surfaces produced using sulfuric anodized surfaces and those produced by the current disclosure.

Figure 7:
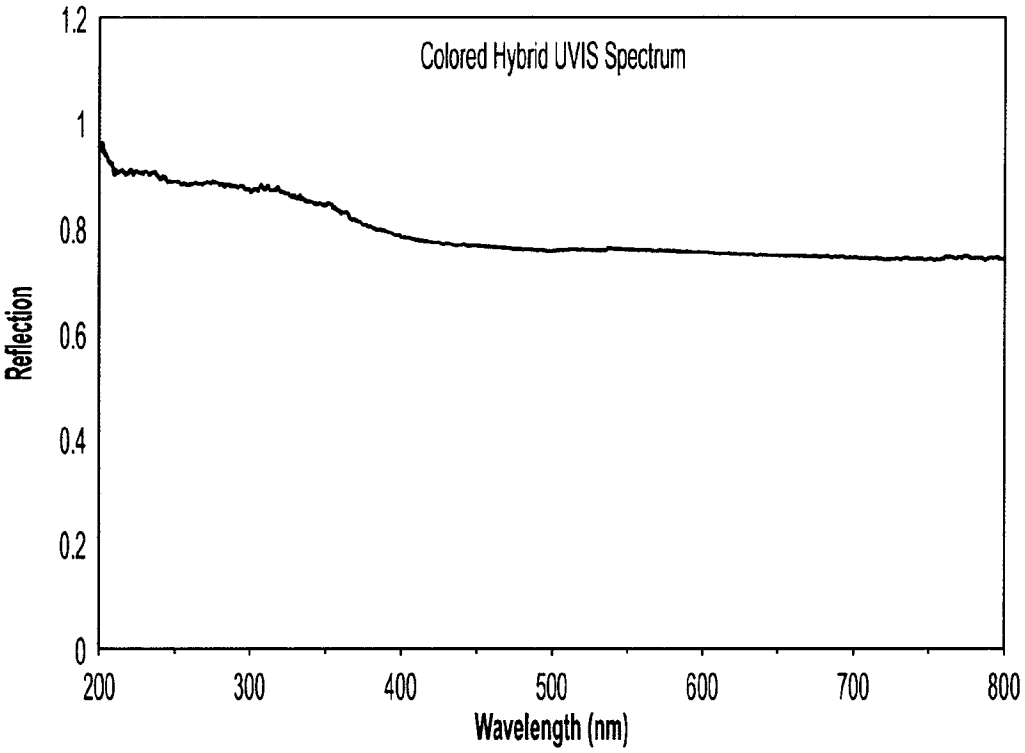
FIG. 7 illustrates an example ultraviolet imaging spectrograph (UVIS) spectrum for a colored hybrid coating on 6061 aluminum of the present disclosure.

FIG. 7 illustrates an example ultraviolet imaging spectrograph (UVIS) spectrum for a colored hybrid coating on 6061 aluminum of the present disclosure. The UVIS spectrum was measured on Spectrophotometer UV2550, commercially available from Labomed Inc. Here, the samples were measured against a barium chloride reference. It is believed that the significant contributor to the virtually flat absorption spectrum, as expected from the black coloring, is plasmonic absorption by the horizontal nano pores. The slightly higher absorption at 200 nm is as result of destructive interference created by the approximately 100 nm pore width, where reflections from the pore walls are significantly attenuated at this wavelength.

EXAMPLES

The following examples point out specific operating conditions and illustrate the practice of the disclosure. However, these examples are not to be considered as limiting the scope of the disclosure. The examples are selected to specifically illustrate aspects of coloration of a thin anodized alloy surface.

Example 1—Effect of $R_a$ (Average Roughness) Reduction Pre-Treatment on Hybrid Anodized 6061 Al with Electrodeposited SB-Ni Eleven samples of a colored coating comprising a thin anodized layer combined with a semi-bright nickel layer provide a dark black surface with various degrees of glossiness.

Each sample was 2 centimeters (cm)×2 cm of 6061 aluminum specimen and was mechanically polished using wet emery paper in several steps from 400 grit to 1200 grit. The mechanical polishing varied for various samples.

Each sample was then soaked in for 8 minutes in a commercial alkaline Prelude AC-100 bath at 70° C. with light air agitation to remove surface contamination. The sample was then rinsed in DI water.

Samples requiring a surface finish with a very low average roughness (Ra) were then electropolished for a period of 0-4 minutes in a bath containing $H_3PO_4$, HF, $H_2SO_4$ and glycerol in a volume ratio 70:2:8:20. The electropolishing bath was maintained at a temperature of 80° C. with a voltage of 12V being applied between the specimen and a Pb cathode to produce a surface with an average roughness (Ra) of between 0.1 and 0.5. The average roughness, Ra, of each sample was measured.

The electropolished substrate was then rinsed in DI water prior to the activation and immersed in 50% by volume nitric acid at room temperature for 1 minute to condition the surface.

The specimens were identically anodized in an anodizing bath at 27° C. for a period of 10 minutes. The anodizing bath composition was $H_3PO_4$ 205 mL/L, $H_2SO_4$ 0.6 mL/L, and HOOCCOOH 1 g/L. Constant current anodizing at 2 A/dm$^2$ was applied. It is believed that constant current anodizing when coloring thin coatings produced a more uniform anodizing pore structure. Under these conditions, the voltage rapidly rises to 58V and, thereafter, drops slowly to about 45V. The anodizing layer was approximately 2.5 microns thick.

In the electro-deposition stage semi-bright nickel was electroplated into the anodizing pores. The bath was a commercial bath of CheMiPure SB, commercially available from CMT Pvt. Ltd of India. The plating time was 90 minutes, and the temperature was 60° C. Initially, the current was ramped from 0 A/dm$^2$ to 0.10 A/dm$^2$ over a period of two minutes, then held constant at 0.1 A/dm$^2$ for 80 minutes. This is compared to a nominal plating current for the selected bath of 2-4 A/dm$^2$. The semi-bright nickel filling thickness was approximately 1 micron of the 2.5-micron anodizing layer.

Figure 10:
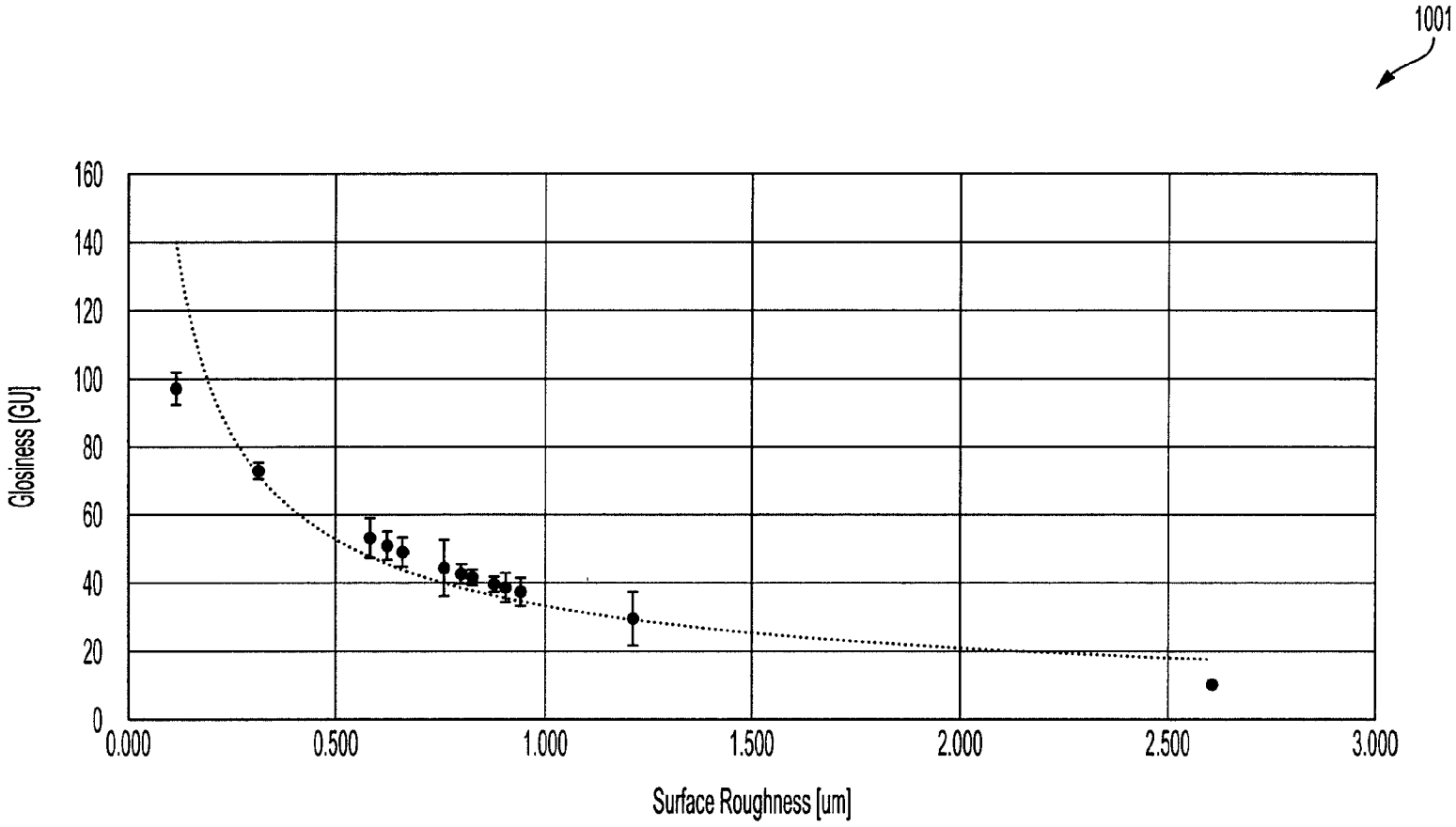
FIG. 10 illustrates an example graph showing the relationship between the average roughness of the substrate and the gloss of a coating of the present disclosure.

The resulting coating was a uniform shiny black color. FIG. 10 is an example graph showing the relationship between the average surface roughness of the substrate and the gloss of a coating of the present disclosure. The graph 1001 shows a fitted curve demonstrating the relationship developed between initial average surface roughness of the substrate and the measured gloss, in gloss units (GU) of the colored coating. GU of 100 is representative of a highly polished reference black sample whereas GU 0 is a perfectly matte sample.

Example 2—Effect of $R_a$ Increase Pre-Treatment on Hybrid Anodized 6061 Al with Electrodeposited SB-Ni A colored coating comprising a thin anodized layer combined with a semi-bright nickel layer develops a matte dark black surface.

A 2 centimeters (cm)×2 cm 6061 aluminum specimen was mechanically polished using wet emery paper of 400 grit, developing an average surface roughness of Ra 2.5.

The sample was then soaked in for 8 minutes in a commercial alkaline Prelude AC-100 bath at 70° C. with light air agitation to remove surface contamination. The sample was then rinsed in DI water.

The substrate was then rinsed in DI water prior to the activation and immersed in 50% by volume nitric acid at room temperature for 1 minute to condition the surface.

The specimen was anodized in an anodizing bath at 27° C. for a period of 10 minutes. The anodizing bath composition was $H_3PO_4$ 205 mL/L, $H_2SO_4$ 0.6 mL/L, and HOOCCOOH 1 g/L. Constant current anodizing at 2 A/dm$^2$ was applied. It is believed that constant current anodizing when coloring thin coatings produces a more uniform density of pores in the anodized structure.

Under these conditions the voltage rapidly rises to 58V and thereafter drops slowly to about 45V. The anodizing layer was approximately 2.5 microns thick. In the electro-deposition stage semi-bright Ni was electroplated into the anodizing pores. The bath was a commercial bath of CheMiPure SB, commercially available from CMT Pvt. Ltd of India. The plating time was 90 minutes, and the temperature was 60° C. Initially, the current was ramped from 0 A/dm$^2$ to 0.10 A/dm$^2$ over a period of two minutes, then held constant at 0.1 A/dm$^2$ for 80 minutes, this is compared to a nominal plating current for the selected bath of 2-4 A/dm$^2$. A thickness was approximately 1 micron.

Figure 4:
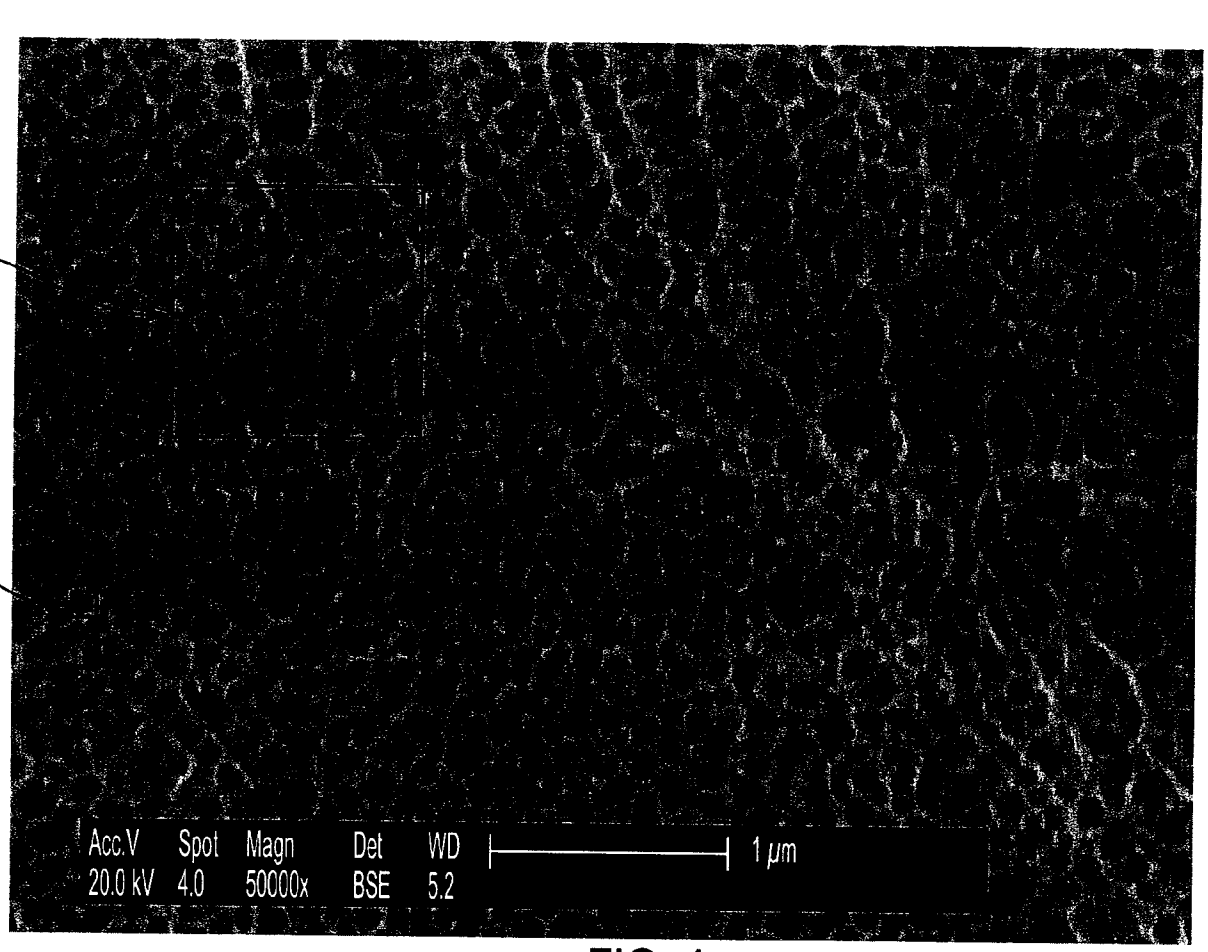
FIG. 4 is a surface electron microscope (SEM) image of an example phosphoric anodized structure of the present disclosure.

The resulting coating was a dull black. FIG. 4 is a scanning electron microscope (SEM) image 401 of an example phosphoric anodized structure of the present disclosure. The SEM image 401 shows an unsealed colored coating on a 6061-aluminum substrate in accordance with one embodiment of the present disclosure. Here, the anodizing voltage was about 58V, giving a pore-density of 60/μm$^2$, as calculated from the 1 micron square 402, and an average pore-width of 80 nm (not visible). The effect of the widening of the pores at the surface can be clearly seen from the 100 nm square 403 with a pore width of about 105 nm.

Figure 6:
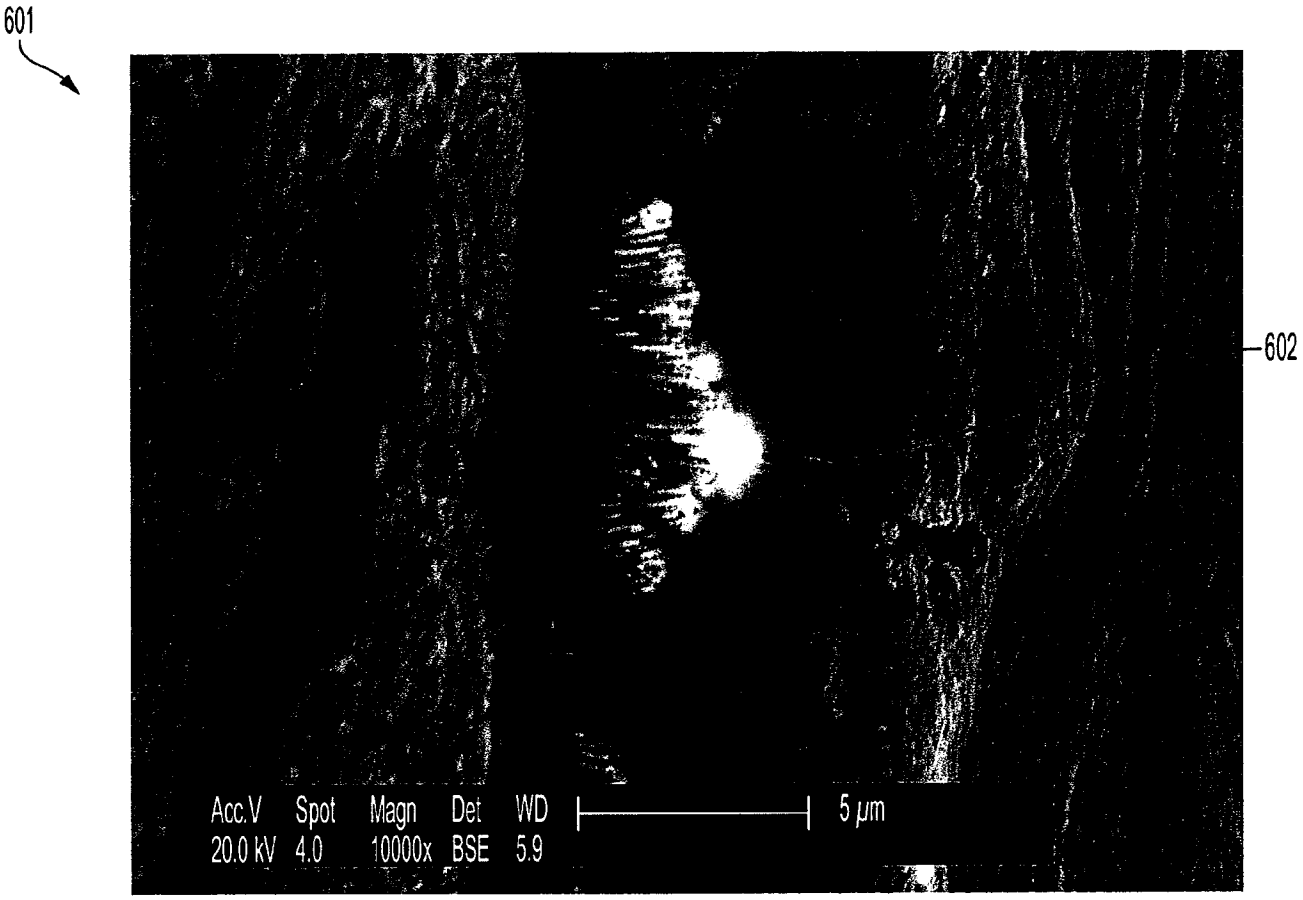
FIG. 6 is a SEM image of an example close up image of a cross-section

FIG. 5 is a SEM image of an example cross-section of an anodized colored substrate of the present disclosure. FIG. 6 is a SEM image of an example close up image of a cross-section of an anodized colored substrate of the present disclosure. In FIGS. 5 and 6, the anodized colored substrate is on 6061 aluminum.

FIG. 5 shows aluminum substrate 501. FIG. 5 illustrates how the horizontal pores connect to the main pores in box 502 at a density of about 1 every 100 nm for the 4% copper content. The horizontal pores are absent nearest the surface, where pore widening due to the anodizing bath dissolution occurs. The coating produced is shown in the inset image 503, which has the following (L*, a*, b*) characteristics (CIELAB) (7.1, −1.0, 0.5).

FIG. 6 shows an aluminum substrate 601. In FIG. 6 the periodic filling of the pores with nickel can be clearly seen shown in box 602.

Example 3—Relationship Between Anodizing Time and Plating Metal Deposition Time in Developing Surface Color Approximately thirty-two substrates of 6061-T6 aluminum were prepared for this example. Each sample was 3 cm×5 cm and prepared identically.

Each sample was then soaked for 10 minutes in a commercial alkaline Prelude AC-100 bath at 70° C. with light air agitation to remove surface contamination. The samples were dipped in 50% nitric acid to de-smut the surface. The samples were rinsed in DI water between each step.

The principal anodizing bath composition was $H_3PO_4$ 205 mL/L, $H_2SO_4$ 0.6 mL/L, and HOOCCOOH 1 g/L. The counter electrode was titanium mesh, and vigorous air agitation was used to refresh the anodizing bath electrolyte at the example surfaces. The anodizing bath was placed in a water bath and the temperature of the solution was maintained between 24±1° C. and 36±1° C. depending on the bath composition and color desired.

The bath composition was varied to support higher anodizing voltages. For voltages between 90 and 120V the $H_2SO_4$ was eliminated and a 75-80% ethanol solution used in place of DI water. From 120-150V, Ethylene Glycol was used as a solvent in place of DI water. >150 V the $H_3PO_4$ was replace with 50% $H_3PO_4$ and 50% $NaH_2PO_4$.

Constant voltage DC anodizing was employed with voltage limited in the range of 60-280 V. In addition, the maximum current was limited to 2.0 A/dm2. Eight samples were anodized at each voltage condition. Anodizing was performed for a variety of periods of between approximately 15 minutes and 25 minutes. The period was determined by the total charge passed, which was calculated for each processed sample from the record of measured voltage and current over the anodizing period. For each voltage, the charged passed was kept constant for the eight samples. After anodizing, samples were immediately rinsed in DI water and then immersed into the metal deposition solution.

In the electro-deposition stage, semi-bright Ni was electroplated into the anodizing pores. The bath was a commercial bath CheMiPure SB, commercially available from CMT Pvt. Ltd of India. The bath was maintained at a temperature of 60° C., and air agitation was used to ensure the uniformity of the deposit. Initially, the current was ramped from 0 A/dm2 to 0.1 A/dm2 over a period of two minutes, then held constant at 0.1 A/dm2 for various periods, as presented in FIG. 8 and discussed in further details below.

Plated samples were rinsed in DI water and carefully dried before color measurements were made by imaging the samples against a white background and using ImageJ 1.52 software to calculate the L, a, b color coordinate magnitudes of the samples.

Figure 8:
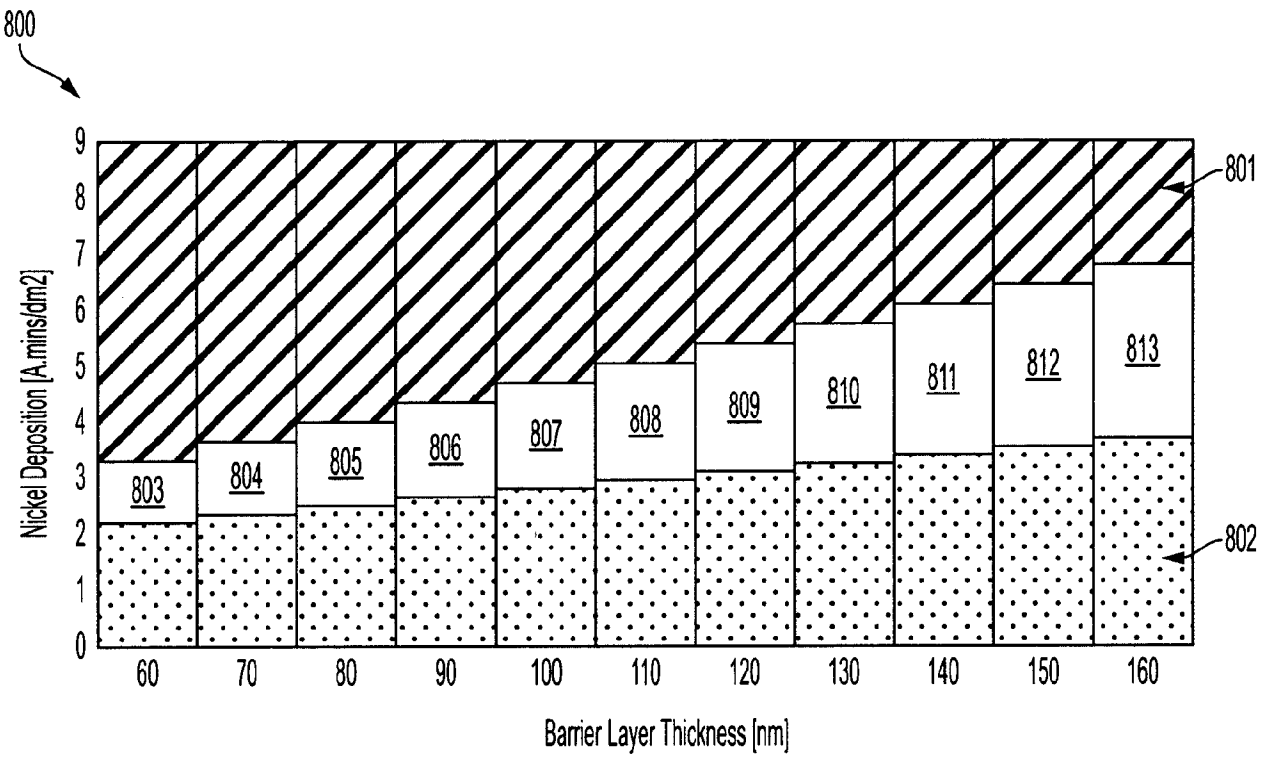
FIG. 8 illustrates an example graph showing a relationship between the anodizing charge passed, the plating amp minutes, and the color in a process of the present disclosure.

The sample data was analyzed to develop a model of the color generation mechanism. FIG. 8 illustrates an example graph showing a relationship between the voltage (from 60-280V), the plating amp minutes (from 2-10 amp minutes), and the color in a process of the present disclosure. The graph in FIG. 8 shows the representative color of the samples as a spectrum for each anodizing voltage and nickel electrodeposition time. In each case, the color for a given anodizing voltage follows a spectrum from silver/grey through a particular color, depending on the anodizing voltage, to a metallic color, depending on the plated metal.

It is understood that several processes may contribute to the coating color. FIG. 6, discussed above, shows a cross-section of an array of partially filled anodizing pores. Low deposition amp-minutes/$dm^2$ (<2 amp-minutes/$dm^2$) of the coloring metal, independent from the anodizing charge passed, results in little or no deposited metal (i.e. very short metal nanorods) (e.g., bars 802 in FIG. 8). Here, light will be mostly reflected by the substrate and will result in the transparency of the barrier layer coloring through the silver-grey appearance of the underlying substrate aluminum alloy (e.g., as determined by the substrate 901 in FIG. 9).

For narrow anodizing pores (e.g., low anodizing voltages), as more metal deposition amp-minutes are applied, the substrate is quickly shielded by nano structured metal 942, illustrated in FIG. 9. The resultant color developed is primarily a function of light absorption by the glossy metal deposition (e.g., the side pores 923 illustrated in FIG. 9). Both the light entering pores (e.g., a light path 920) and light entering the anodized layer reflected from the substrate (e.g., a light path 940) contribute to light absorption. This produces a band of black or grey color as shown by bar 803 in FIG. 8. However, higher anodizing voltages may form wider pores with a corresponding ease of metal deposition, which results in a compact metal layer at the base of the pores. Here, the coating color is dominated by a combination of light absorption within the pores, as previously described, and a blue spectrum of colors that are developed by selective absorption of light traversing the barrier layer (e.g., the barrier layer 902 illustrated in FIG. 9) of these thicknesses. As the anodizing voltage increases, the pores widen, and a predominant color is developed for each anodizing voltage, from violet purple (the bar 803 of FIG. 8), shades of blue (bars 804-806 of FIG. 8), greens (bars 807-808 of FIG. 8), yellow (bar 809 of FIG. 8), oranges (bar 811-812 of FIG. 8), and red (bar 813 of FIG. 8). As the pores widen, the range of metal deposition amp-minutes during which color is perceivable increases.

As metal deposition amp-minutes increases, the average pore filling also increases. At high amp-minutes, metallic colors predominate (as shown by bars 801 in FIG. 8). However, due to variations in the nucleation process, a periodic range of filling occurs (e.g., as illustrated in the image shown in FIG. 5). Three color generation mechanisms compete to develop the perceived coating color. Firstly, the depth of the deposited metal controls the amount of light absorption. Here, the filling of the side pores presents extra absorbance by plasmonic effects, as shown by the image in FIG. 5.

Secondly, light that is refracted and reflected down between the barrier layer and underlying aluminum substrate is then filtered in a manner decided by the geometry and length of the light pipe (e.g., the light path illustrated by the line 940 in FIG. 9). The frequency selectivity of this light pipe is proportional to its length, which depends on the depth of the metal in the pores, the pore diameter, and anodized film barrier layer thickness. Those skilled in the art will recognize that there are multiple effective lengths of the light pipe depending on the incident angle and associated reflections; thus, there is a spectrum of transmission and absorption.

Lastly, light is directly reflected from the metal surface, where the distance between the metal surface, and top of the pore produces either destructive or constructive interference depending on the path length and light wavelength, as illustrated by the light path shown by lines 920 and 922 in FIG. 9.

The distribution of wavelengths that exit the coating produces the perceived color of the coating, and the total absorption of incident light within the structure gives rise to the darkness or decreased luminance of the resultant color, where at the extreme, the coating tends towards black. Narrower pores, and consequently narrower side walls, are more constrained light paths, which give rise to greater control over the coating color. This may lead to wider bands of metal deposition over which a single color is perceived.

Table 1 shows the color produced (RGB) and color variation across the surface (ΔE) for several anodizing voltages and temperatures, higher temperatures in any bath formulation increases the porosity of the anodizing and darkens the color.

TABLE 1

| Anodizing | | Color | | | | |
|---|---|---|---|---|---|---|
| V | ° C. | Name | R | G | B | ΔE |
| 60 | 24.0 | Light Grey | 130 | 132 | 139 | 1.9 |
| 60 | 25.5 | Dark Grey | 73 | 75 | 81 | 1.3 |
| 60 | 27.0 | Black | 37 | 44 | 52 | 1.1 |
| 70 | 27.0 | Dark Blue/Purple | 67 | 88 | 143 | 1.3 |
| 80 | 27.0 | Dark Blue | 44 | 72 | 125 | 1.6 |
| 80 | 28.0 | Mid Blue | 43 | 107 | 187 | 0.5 |
| 90 | 27.0 | Blue | 44 | 76 | 144 | 1.5 |

TABLE 1-continued

| Anodizing | | Color | | | | |
|---|---|---|---|---|---|---|
| V | ° C. | Name | R | G | B | ΔE |
| 100 | 28.0 | Light Blue | 71 | 114 | 145 | 1.3 |
| 110 | 30.0 | Blue Green | 77 | 127 | 152 | 1.3 |
| 120 | 27.0 | Baby Blue | 112 | 163 | 202 | 0.7 |
| 130 | 23.0 | Blue Grey | 150 | 168 | 179 | 0.6 |
| 160 | 36.0 | Bronze | 129 | 107 | 86 | 2.0 |

Example 4—Relationship Between Phosphoric Acid Concentration and Maximum Anodizing Thickness Fifteen substrates of 6061-T6 aluminum were prepared identically.

Each sample was then soaked for 10 minutes in a commercial alkaline Prelude AC-100 bath at 70° C. with light air agitation to remove surface contamination. The samples were dipped in 50% nitric acid to de-smut the surface. The samples were rinsed in DI water between each step.

The anodizing bath composition was $H_3PO_4$ (between 100 ml/l and 210 ml/l depending on the sample), $H_2SO_4$ (0.6 mL/L), and HOOCCOOH (1 g/L) in each case. The counter electrode was titanium mesh, and vigorous air agitation was used to refresh the anodizing bath electrolyte at the example surfaces. The anodizing bath was placed in a water bath, and the temperature of the solution was maintained at 25±1° C.

Constant voltage DC anodizing was employed, with voltage limited to 60 V. In addition, the maximum current was limited to 2.0 A/dm2. Anodizing was performed for a variety of periods of between approximately 20 minutes and 120 minutes. The period was determined by the total charge passed, which was calculated for each sample processing from the record of measure voltage and current over the anodizing period.

Each sample was rinsed in DI water and thoroughly dried. The samples were cross sectioned and mounted as metallographic specimens, and the anodizing film thickness was measured.

Figure 11:
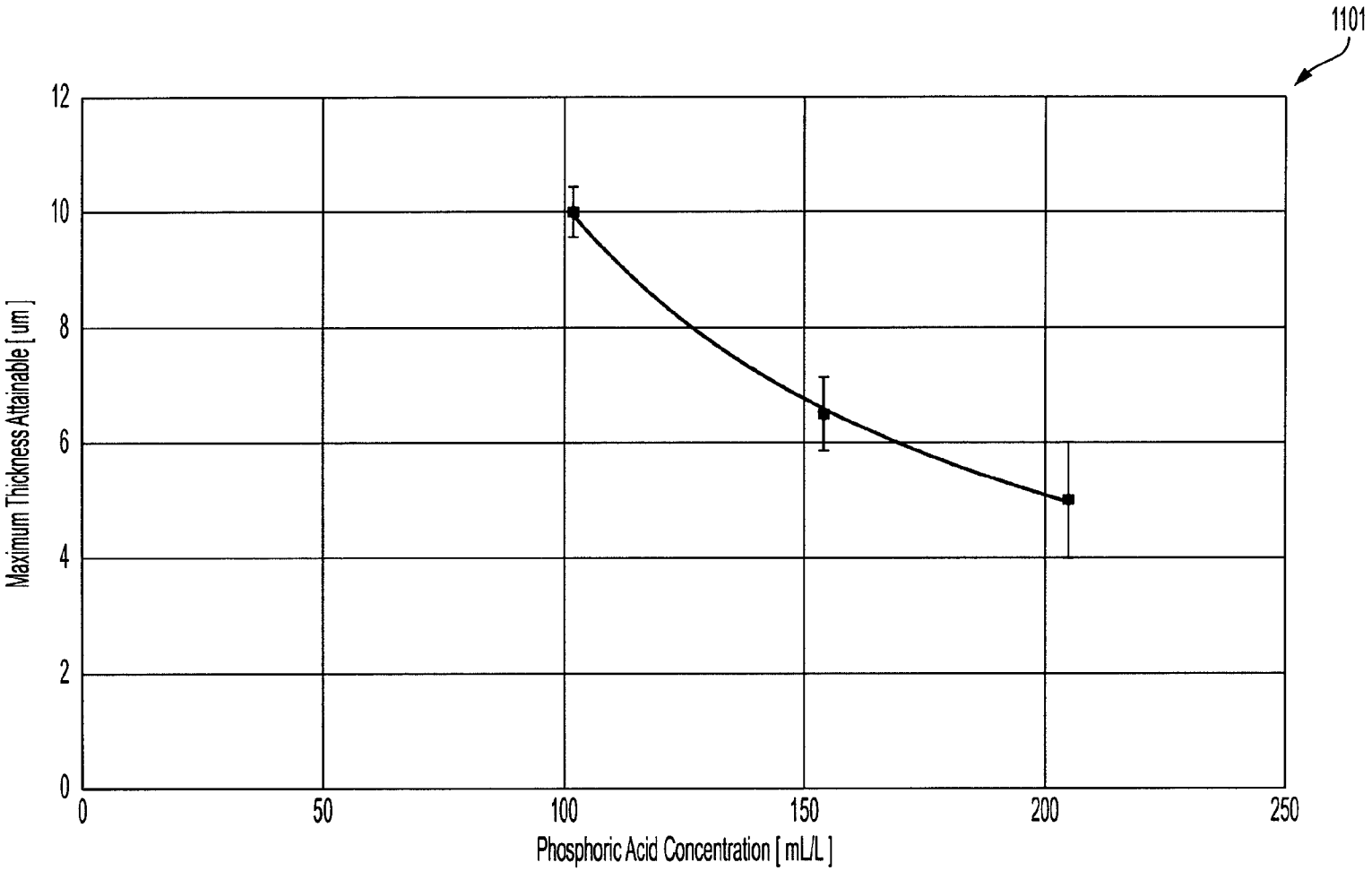
FIG. 11 illustrates an example graph showing the maximum achievable anodizing layer thickness for several phosphoric acid concentrations of the present disclosure.

FIG. 11 illustrates an example graph showing the maximum achievable anodizing layer thickness for several phosphoric acid concentrations of the present disclosure. The graph 1101 shows the relationship between the maximum anodizing film thickness achievable for the phosphoric acid concentration in the bath. As mentioned previously, thick films provide improved mechanical properties of the coating at the expense of time to generate the film and clarity of the colored coating.

Example 5—The Effect of Barrier Layer Thinning and Anodizing Bath Temperature on a Dark Grey Colored Coating Five substrates of 6022-T4 aluminum were prepared identically.

Each sample was then soaked in for 10 minutes in a commercial alkaline Prelude AC-100 bath at 70° C. with light air agitation to remove surface contamination. The samples were soaked in a ProbrightAl™ alkaline cleaner at room temperature for 2 minutes. The samples were then de-smutted in 50% nitric acid at room temperature for 90 seconds. The samples were electropolished in a bath containing $H_3PO_4$, HF, $H_2SO_4$, and glycerol in a volume ratio selected from the following ranges 70-85:2-4:6-9:5-20. The electropolishing bath was held at a temperature of 65 Celsius (° C.) at a voltage (V) of 12V and a Pb counter electrode for a period between 0 and 8 minutes. The samples were rinsed in DI water between each step.

The anodizing bath composition was $H_3PO_4$ (between 150 ml/l and 250 ml/l, depending on the sample), $H_2SO_4$ (0.6 mL/L), and HOOCCOOH (1 g/L) in each case. The counter electrode was titanium mesh, and vigorous air agitation was used to refresh the anodizing bath electrolyte at the example surfaces. The anodizing bath was placed in a water bath, and the temperature of the anodizing bath was maintained using ice, such that the temperature varied between 27 and 33±3° C. depending on the sample.

Constant voltage DC anodizing was employed, with voltage limited to 60 V. In addition, the maximum current was limited to 2.0 A/dm2. Anodizing was performed for 20 minutes, and a variety of barrier layer thinning periods were applied to each sample, for a total of 10 to 12 minutes of reduced anodizing voltage(s) of 30 V and/or 15 V. After anodizing, the samples were rinsed in DI water and immediately placed in the electroplating bath.

The samples were placed in a Chemipure/Niflow semi-bright nickel-plating bath, commercially available from CMP India. The bath was maintained at 60° C., and the anode was nickel chips in a bagged titanium mesh basket. The samples were initially soaked for 3 minutes to allow the nickel ions to penetrate the pores. The plating current was ramped from 0 to 0.1 A/dm$^2$ over a period of 2 minutes, after which the current was maintained at 0.1 A/dm$^2$ for a further 2 minutes, after which the current was increased to 0.3 A/dm$^2$ for a further period of 10 minutes. The samples were then rinsed and dried.

Figure 12:
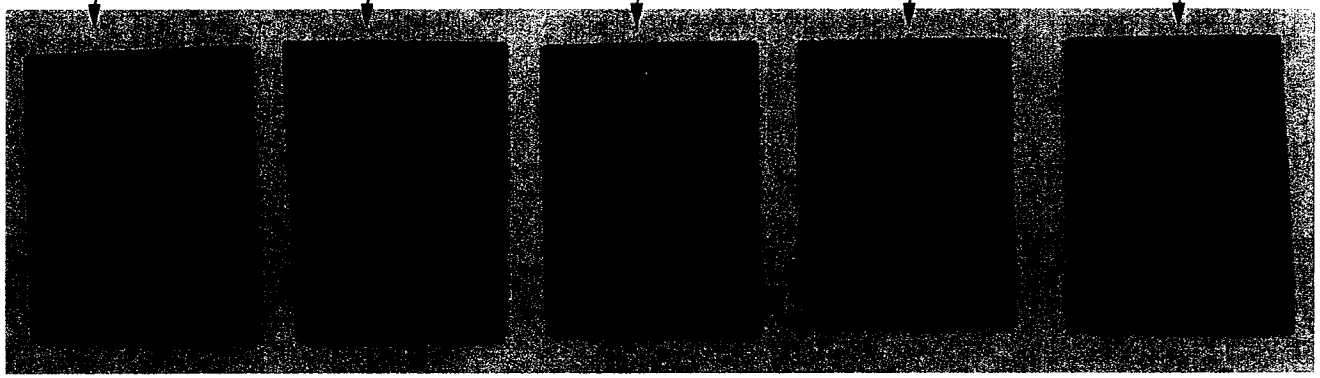
FIG. 12 is a set of example images and a table showing the effects of barrier layer thinning and the temperature on the coating color of the present disclosure.

FIG. 12 is a set of example images and a table showing the effects of barrier layer thinning and temperature on the coating color of the present disclosure. FIG. 12 shows resulting samples 1201-1205, color profiles, and anodizing temperatures. The anodizing bath temperature slightly affects pore size and barrier layer thickness, but significantly affects the total dissolution rate of the anodized layer in the phosphoric acid bath. The level and extent of barrier layer thinning also controls how much of the visible spectrum of light is filtered out from the light that is reflected out of the coating. This gives rise to the variation in color, where in FIG. 12 the five samples 1201-1205 all exhibit a dark grey color, but samples 1201, 1202, and 1205 include a blue hue; sample 1203 includes a red hue; and sample 1204 displays a hue of orange-yellow. Table 1206 provides various processing parameters for each one of the samples 1201-1205.

Example 6—Effect of Copper on Color

Three substrates of 6061-T6 aluminum, and three substrates of 6022-T4 aluminum were prepared identically.

Each sample was soaked for 10 minutes in a commercial alkaline Prelude AC-100 bath at 70° C. with light air agitation to remove surface contamination. The samples were dipped in 50% nitric acid to de-smut the surface. The samples were rinsed in DI water between each step.

The anodizing bath composition was $H_3PO_4$ (between 30 ml/l and 300 ml/l depending on the sample), $H_2SO_4$ (0.6 mL/L), and HOOCCOOH (1 g/L) in each case. The counter electrode was titanium mesh, and vigorous air agitation was used to refresh the anodizing bath electrolyte at the example surfaces. The anodizing bath was placed in a water bath, and the temperature of the solution was maintained at 25±1° C.

Constant voltage DC anodizing was employed with voltage limited in the range of 60-100 V depending on the 6061/6022 comparison pair of samples. In addition, the maximum current was limited to 2.0 A/dm2. Anodizing was performed for a variety of periods of between approximately 20 minutes and 120 minutes. The period was determined by the total charge passed, which was calculated for each sample processing from the record of measured voltage and current over the anodizing period.

Each sample was rinsed in DI water and thoroughly dried. The samples were cross sectioned and mounted in resin via metallographic preparation. The anodizing film was inspected for pore size as well as the prevalence, size, and frequency of side pores (1204 in FIG. 12) creating interporosity.

As shown in Table 1 below, for an identical anodizing voltage and charge passed, the 6061 samples had larger and more numerous side pores compared to 6022 samples; however, the 6022 aluminum alloy samples had wider pore diameters. The side pore volume developed is roughly proportional to the copper content of the alloy, while the main pore volume change is related to the side pore volume.

The luminance measured for the 6022 and 6061 aluminum alloy samples was 45.4 and 25.8, respectively. The change in luminance directly corresponds to the side pore diameter variation, the postulated light absorption by side pores 923, and the light path represented by the line 920 illustrated in FIG. 12, and described above.

TABLE 2

| Alloy | Cu wt. % | d-pore base (nm) | d-side pore (nm) | Main Pore Volume (%) | Side-pore volume (%) | Total Pore volume (%) |
|---|---|---|---|---|---|---|
| 6022 | 0.01-0.1 | 98.8 ± 6.1 | 24.1 ± 1.7 | 37.7 ± 10.0 | 2.9 ± 0.8 | 40.6 ± 10.8 |
| 6061 | 0.15-0.4 | 85.0 ± 6.9 | 50.4 ± 5.5 | 24.9 ± 4.0 | 18.2 ± 5.0 | 43.1 ± 9.0 |

Example 7—The Effect of Pore Plugging and Sealing

Ten 100×25 mm 6061 aluminum substrates were anodized and colored to produce a dark grey surface as previously described. Samples were either unsealed, sealed with DUDMA only, or pMMA nano pore plugged (to retain the air gap) followed by a DUDMA seal.

For the DUDMA seal, a solution of ZnO nanoparticles in DI water was applied to the surface and dried to act as a surface initiator and retain the clarity of the pDUDMA coating. The surface was then dipped three times in pure DUDMA monomer diluted 80% by volume with Tetrahydrofuran (THF) and an organic to control the evaporation, e.g. acetone or ethyl acetate. Samples were exposed to intense UV light, with a principal wavelength 365 nm, while being simultaneously heated to 75±5° C. After 30 minutes the DUDMA polymerized to a transparent coating.

MMA nanoparticles were previously prepared to plug the openings of the porous anodized coating. 180 mL of deionized water, with 0.070 g Potassium Bicarbonate ($KHCO_3$), 0.024 g Ammonium Persulfate (APS), and 0.029 g Sodium Dodecyl Sulfate (SDS), was added to a 300 mL Erlenmeyer flask, stirring at 600 rpm by magnetic stirring The solution was heated to 75° C., where 5 mL of Methyl Methacrylate (MMA) monomer was added to the flask, followed by 0.0070 g of Sodium Bisulfite ($NaHSO_3$). The flask was loosely sealed with a stopper, and the temperature monitored over the 3 hours. The solution was then removed immersed into an ice bath to rapidly cool to room temperature.

Thermogravimetric analysis showed a yield of 90% conversion of MMA monomer to PMMA nanoparticles. Dynamic Light Scattering showed the average particle size to be 110 nm, with a polydispersity index of 0.02.

Color change was measured by photographing that samples in a light cabinet with the images processed in Imagej software to determine the color in RGB and variance between the average color between the sample ΔE as.

$$\Delta E=\sqrt{(\sigma_R)^2+(\sigma_G)^2+(\sigma_B)^2}$$

The sealed sample provided 8-times improvement in corrosion performance as shown in Table 2 but the apparent color was perceptibly different. This different was more noticeable with lighter samples where the ΔE was >20. The samples with the nanoparticle pore plug and pDUDMA seal had a 20-times improvement is corrosion resistance and an imperceptible color change.

Corrosion performance was measured by neutral salt spray testing following standard B117. Samples rinsed dried and analyzed daily for corrosion. The time to first corrosion was recorded.

TABLE 3

| Seal Description | Hours until first corrosion point | Sample color change ΔE |
|---|---|---|
| Unsealed control | 48 | n/a |
| pDUDMA seal | 336 | 5.1 |
| pMMA NP Plug and pDUDMA Seal | 1100 | 0.1 |

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A method to create a colored surface, comprising the steps of:

(a) anodizing a substrate in an anodizing bath comprising phosphoric acid, at a constant temperature and a constant voltage for a first time period to develop an anodizing layer having one or more main pores; wherein each of the one or more main pores includes one or more side pores; wherein the anodizing layer includes a barrier layer;

(b) reducing the constant voltage applied to the anodizing bath for a second time period to change a thickness of the barrier layer and change a width of the one or more main pores in the anodizing layer;

(c) plating the substrate in a plating bath to at least partially fill the one or more main pores and the one or more side pores and develop a plasmonic surface at a first current that is increased over a third time period in accordance with a current profile of the plating bath;

(d) plating the substrate in the plating bath at a second current for a fourth time period to partially fill the one or more main pores and the one or more side pores with metal nanorods; and (e) applying a sealing layer over the one or more main pores of the anodizing layer and forming an air gap between the metal nanorods and the sealing layer.

2. The method of claim 1, wherein the substrate comprises an aluminum alloy.

3. The method of claim 1, wherein in step (a) the constant temperature is a temperature between 20 degrees Celsius and 40 degrees Celsius.

4. The method of claim 1, wherein in step (a) the constant voltage is a voltage between 60 Volts and 280 Volts, with a maximum current density of 2 amperes per square decimeter.

5. The method of claim 1, wherein in step (b) the constant voltage is reduced by 50%, and the second time period comprises between 2 and 10 minutes and then reduced by a further 50% for a third time period of between 1 and 4 minutes.

6. The method of claim 1, wherein in step (b) the voltage applied to the anodizing bath is reduced to (i) reduce the thickness of the barrier layer, and (ii) to increase the width of the one or more main pores in the anodizing layer.

7. A method to create a plasmonic colored surface, comprising the steps of:

(a) anodizing an aluminum alloy substrate in an anodizing bath comprising phosphoric acid, at a constant temperature and a constant direct or pulsed current and/or voltage for a first time period to develop an anodizing layer of between 2 and 10 microns thick having one or more main pores; wherein the one or more main pores include one or more side pores; wherein the anodizing layer includes a barrier layer;

(b) reducing the constant direct or pulsed current and/or voltage applied to the anodizing bath for a second time period to change a thickness of the barrier layer and change a width of the one or more main pores in the anodizing layer;

(c) plating the aluminum alloy substrate in a plating bath at a first current that is increased over a third time period in accordance with a direct current (DC) plating current profile of the plating bath;

(d) plating the aluminum alloy substrate in the plating bath at a second current for a fourth time period to at least partially fill the one or more main pores and the one or more side pores in the anodizing layer and develop a plasmonic surface; and (e) sealing the one or more main pores of the anodizing layer resulting in an air gap formed between the one or more main pores and a sealing layer.

8. The method of claim 7, wherein in step (a) the anodizing bath comprises 50-600 milliliters per liter (ml/L) of phosphoric acid, 1-15 ml/L of sulfuric acid, and 1-10 grams per liter (g/L) of oxalic acid.

9. The method of claim 7, wherein in step (a) the anodizing bath further comprises 1 to 5 weight percent of copper sulfate and ethylenediaminetetraacetic acid (EDTA).

10. The method of claim 7, wherein in step (c) the plating bath comprises a semi-bright nickel bath with a nominal plating current of between 2 amperes per square decimeter ($A/dm^2$) and 4 $A/dm^2$.

11. The method of claim 7 wherein in step (d) the plating of the substrate partially fills the pores in the anodizing layer with metal nanorods.

12. A method, comprising the steps of:

(a) pre-treating an aluminum alloy substrate;

(b) activating the aluminum alloy substrate;

(c) anodizing the aluminum alloy substrate in an anodizing bath comprising phosphoric acid, at a constant temperature and a constant voltage for a first time period, to develop an anodizing layer having one or more main pores; wherein the one or more main pores include one or more side pores; that includes a barrier layer;

(d) reducing the constant voltage applied to the anodizing bath for a second time period to change a thickness of the barrier layer and change a width of the one or more main pores in the anodizing layer;

(e) plating the aluminum alloy substrate in a plating bath via multiple plating stages to deposit metal nanorods into the one or more main pores and the one or more side pores of the anodizing layer; and (f) sealing the one or more main pores of the anodizing layer resulting in an air gap formed between the one or more main pores and a sealing layer.

13. The method of claim 12, wherein the pre-treating step (a) modifies the average roughness (Ra) of the aluminum alloy substrate and comprises:

degreasing the aluminum alloy substrate in an alkaline bath;

roughening the aluminum alloy substrate in a solution of phosphoric acid, polyethylene glycol, sulfuric acid, and hydrofluoric acid; and etching the aluminum alloy substrate in a nitric acid solution to develop an Ra of between 0.4 and 1.8.

14. The method of claim 12, wherein in step (e) the multiple plating stages comprise: a first plating stage that applies a first current that is increased over a third time period in accordance with a current profile of the plating bath; and a second plating stage that applies a constant second current for a fourth time period.

15. The method of claim 12 wherein in step (f) the step of sealing the pores of the anodizing layer, the air gap is maintained between the pores and a sealing layer by a nanoparticle configured to plug the pores.

16. A method to create a plasmonic colored surface, comprising the steps of:

(a) anodizing a substrate in an anodizing bath comprising phosphoric acid, at a constant temperature and a constant voltage for a first time period to develop an anodizing layer having one or more main pores; wherein each of the one or more main pores include one or more side pores; wherein the anodizing layer includes a barrier layer;

(b) reducing the constant voltage applied to the anodizing bath for a second time period to change a thickness of the barrier layer and change a width of the one or more main pores in the anodizing layer;

(c) plating the substrate in a plating bath to fill or partially fill the one or more main pores and the one or more side pores and develop a plasmonic surface, at a first current that is increased over a third time period in accordance with a current profile of the plating bath;

(d) plating the substrate in the plating bath at a second current for a fourth time period; and (e) sealing the one or more main pores of the anodizing layer resulting in an air gap formed between the one or more main pores and a sealing layer.

* * * * *